US008413410B2

(12) United States Patent
Ulm et al.

(10) Patent No.: US 8,413,410 B2
(45) Date of Patent: Apr. 9, 2013

(54) DEVICES FOR CAPPING VIALS USEFUL IN SYSTEM AND METHOD FOR DISPENSING PRESCRIPTIONS

(75) Inventors: Timothy Ulm, Raleigh, NC (US); John Richard Sink, Raleigh, NC (US); Eric X. Bonpain, Cary, NC (US); Mark Alan Uebel, Raleigh, NC (US)

(73) Assignee: Parata Systems, LLC, Durham, NC (US)

( * ) Notice: Subject to any disclaimer, the term of this patent is extended or adjusted under 35 U.S.C. 154(b) by 226 days.

(21) Appl. No.: 12/771,156

(22) Filed: Apr. 30, 2010

(65) Prior Publication Data

US 2011/0265430 A1 Nov. 3, 2011

(51) Int. Cl.
*B67B 3/20* (2006.01)

(52) U.S. Cl. ..... 53/334; 53/367; 53/331.5; 81/3.29; 81/3.39

(58) Field of Classification Search ..... 53/317, 53/318, 334, 331.5, 367; 81/3.26, 3.36, 3.39, 81/3.32, 3.31

See application file for complete search history.

(56) References Cited

U.S. PATENT DOCUMENTS

| | | | |
|---|---|---|---|
| 2,496,877 | A | 2/1950 | Krueger |
| 2,589,693 | A | 3/1952 | Hess |
| 2,665,775 | A | 1/1954 | Smith |
| 2,708,996 | A | 5/1955 | Skillman |
| 2,865,532 | A | 12/1958 | Smith |
| 3,023,851 | A | 3/1962 | Stiller |
| 3,144,958 | A | 8/1964 | Gumpertz |
| 3,160,793 | A | 12/1964 | Colburn |
| 3,179,288 | A | 4/1965 | Davy |
| 3,185,851 | A | 5/1965 | D'Emilio |
| 3,196,276 | A | 7/1965 | Naab |
| 3,206,062 | A | 9/1965 | Rappaport |
| 3,310,199 | A | 3/1967 | Roberts |
| 3,312,372 | A | 4/1967 | Cooper, Jr. |
| 3,410,450 | A | 11/1968 | Fortenberry |
| 3,417,542 | A | 12/1968 | Merrill |
| 3,436,736 | A | 4/1969 | Platt |
| 3,556,342 | A | 1/1971 | Guarr |
| 3,599,152 | A | 8/1971 | Williams |

(Continued)

FOREIGN PATENT DOCUMENTS

| | | |
|---|---|---|
| CA | 936 501 | 11/1973 |
| DE | 199 46 374 A1 | 3/2001 |

(Continued)

OTHER PUBLICATIONS

International Search Report and Written Opinion re PCT/US2008/000527 dated Feb. 10, 2009.

(Continued)

*Primary Examiner* — M. Alexandra Elve
*Assistant Examiner* — Andrew M Tecco
(74) *Attorney, Agent, or Firm* — Myers Bigel Sibley & Sajovec

(57) ABSTRACT

An apparatus for securing a cap onto a cylindrical container includes a main stage and three clamps. Each of the clamps is pivotally attached to the main stage and rotatable about a respective axis of rotation. The axes of rotation of the clamps define an outer circle having a center. Each of the clamps comprises a generally planar body and an arcuate edge and can be used to both center a cap and grip and rotate a vial for attachment of the cap.

3 Claims, 25 Drawing Sheets

U.S. PATENT DOCUMENTS

| | | | | |
|---|---|---|---|---|
| 3,653,176 | A | 4/1972 | Gess | |
| 3,674,040 | A | 7/1972 | Howells et al. | |
| 3,730,388 | A | 5/1973 | Bender | |
| 3,732,544 | A | 5/1973 | Obland | |
| 3,780,907 | A | 12/1973 | Colburn | |
| 3,815,780 | A | 6/1974 | Bauer | |
| 3,837,139 | A | 9/1974 | Roseberg | |
| 3,852,941 | A | 12/1974 | Bross | |
| 3,885,702 | A | 5/1975 | Joslin | |
| 3,917,045 | A | 11/1975 | Williams | |
| 4,045,276 | A | 8/1977 | Zodrow | |
| 4,222,214 | A | 9/1980 | Schultz et al. | |
| 4,267,942 | A | 5/1981 | Wick | |
| 4,434,602 | A | 3/1984 | Culpepper | |
| 4,546,901 | A | 10/1985 | Buttarazzi | |
| 4,573,606 | A | 3/1986 | Lewis | |
| 4,655,026 | A | 4/1987 | Wigoda | |
| 4,662,153 | A * | 5/1987 | Wozniak | 53/331.5 |
| 4,664,289 | A | 5/1987 | Shimizu | |
| 4,674,259 | A | 6/1987 | Hills | |
| 4,674,651 | A | 6/1987 | Scidmore | |
| 4,693,057 | A | 9/1987 | Rittinger | |
| 4,695,954 | A | 9/1987 | Rose | |
| 4,696,144 | A | 9/1987 | Bankuty | |
| 4,762,029 | A | 8/1988 | Chen | |
| 4,766,542 | A | 8/1988 | Pilarczyk | |
| 4,767,023 | A | 8/1988 | Hackmann | |
| 4,805,377 | A | 2/1989 | Carter | |
| 4,852,431 | A * | 8/1989 | Frangel | 81/3.2 |
| 4,869,392 | A | 9/1989 | Moulding, Jr. | |
| 4,918,604 | A | 4/1990 | Baum | |
| 4,919,014 | A | 4/1990 | Chen et al. | |
| 4,971,513 | A | 11/1990 | Bergerioux | |
| 4,979,350 | A | 12/1990 | Amemann | |
| 4,980,292 | A | 12/1990 | Elbert | |
| 4,984,709 | A | 1/1991 | Weinstein | |
| 5,016,422 | A | 5/1991 | Popp et al. | |
| 5,018,644 | A | 5/1991 | Hackmann | |
| 5,047,948 | A | 9/1991 | Turner | |
| 5,437,140 | A | 8/1995 | Molinaro | |
| 5,437,361 | A | 8/1995 | Ohmori et al. | |
| 5,438,814 | A | 8/1995 | Lovett et al. | |
| 5,617,765 | A | 4/1997 | Bennett | |
| 5,647,251 | A * | 7/1997 | Hardman | 81/3.2 |
| 5,809,742 | A | 9/1998 | Takakusaki et al. | |
| 5,819,508 | A | 10/1998 | Kraft et al. | |
| 6,115,992 | A | 9/2000 | Bankuty et al. | |
| 6,182,534 | B1 * | 2/2001 | Hardman | 81/3.2 |
| RE37,829 | E | 9/2002 | Charhut | |
| 6,508,046 | B1 | 1/2003 | Resterhouse et al. | |
| 6,519,913 | B2 | 2/2003 | Higashizaki et al. | |
| 6,945,011 | B2 | 9/2005 | Hidding et al. | |
| 7,082,739 | B2 | 8/2006 | Guemieri et al. | |
| 7,131,245 | B2 * | 11/2006 | Joerg et al. | 53/317 |
| 7,152,505 | B2 * | 12/2006 | Chan et al. | 81/3.4 |
| 7,565,785 | B2 * | 7/2009 | Sink et al. | 53/331.5 |
| 7,596,932 | B2 * | 10/2009 | Sink et al. | 53/485 |
| 7,735,301 | B2 * | 6/2010 | Sink et al. | 53/485 |
| 2002/0139165 | A1 | 10/2002 | Ronchi | |
| 2008/0141631 | A1 | 6/2008 | Brown | |
| 2008/0168751 | A1 * | 7/2008 | Sink et al. | 53/490 |
| 2009/0028684 | A1 * | 1/2009 | Sink et al. | 414/754 |
| 2009/0028685 | A1 * | 1/2009 | Sink et al. | 414/781 |

FOREIGN PATENT DOCUMENTS

| | | |
|---|---|---|
| GB | 1 168 758 | 10/1969 |
| GB | 1 411 951 | 10/1975 |
| JP | 61-104904 | 5/1986 |
| JP | 63-208410 | 8/1988 |
| JP | 1-288265 | 11/1989 |
| JP | 2-028417 | 1/1990 |

OTHER PUBLICATIONS

Partial International Search Report for PCT/US2008/000527; mailed Jul. 16, 2008.

* cited by examiner

DEVICES FOR CAPPING VIALS USEFUL IN SYSTEM AND METHOD FOR DISPENSING PRESCRIPTIONS

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. For example, the reliability of the capping operation may be improved and desirable. Also, the ability to accommodate multiple styles and sizes of vials and caps with a single mechanism may also be desirable.

SUMMARY OF THE INVENTION

As one aspect, embodiments of the present invention are directed to an apparatus for securing a cap onto a cylindrical container. The apparatus comprises a main stage and three clamps. Each of the clamps is pivotally attached to the main stage and rotatable about a respective axis of rotation. The axes of rotation of the clamps define an outer circle having a center. Each of the clamps comprises a generally planar body and an arcuate edge, wherein the arcuate edge comprises, in serial order: a first contact section; a first single tooth; a second contact section; a second single tooth; a third contact section; a third single tooth; and a fourth contact section. Each of the first, second and third teeth has a tip. Each of the first, second and third teeth are located on the arcuate edge such that, when the clamps are pivoted about their respective axes of rotation, the tips of the first teeth present the leading points of contact of the clamps in a first annulus concentric with the outer circle and having inner and outer diameters of between about 1.800 and 1.975 inches, the tips of the second teeth present the leading points of contact of the clamps in a second annulus concentric with the outer circle and having inner and outer diameters of between about 1.430 and 1.530 inches, and the tips of the third teeth present the leading points of contact of the clamps in a third annulus concentric with the outer circle and having inner and outer diameters of between about 1.200 and 1.325 inches.

As a second aspect, embodiments of the present invention are directed to an apparatus for securing a cap onto a cylindrical container comprising a main stage and three clamps. Each of the clamps is pivotally attached to the main stage and rotatable about a respective axis of rotation, wherein the axes of rotation of the clamps define an outer circle having a center. Each of the clamps comprises a generally planar body and an arcuate edge, wherein the arcuate edge comprises, in serial order: a first contact section; at least one first screw thread; a second contact section; at least one second screw thread; a third contact section; at least one third screw thread; and a fourth contact section.

As a third aspect, embodiments of the present invention are directed to an apparatus for securing a cap onto a cylindrical container, comprising a main stage and three clamps. Each of the clamps is pivotally attached to the main stage and rotatable about a respective axis of rotation, wherein the axes of rotation of the clamps define an outer circle having a center. Each of the clamps comprises a generally planar body and an arcuate edge, wherein the arcuate edge comprises a toothed section and a contact section. Rotation of each of the clamps from a rest position in a first rotative direction presents the contact section of each clamp to an object resting on the main stage, and rotation of each of the clamps from the rest position in a second opposite rotative direction presents the toothed section of each clamp to an object resting on the main stage.

As a fourth aspect, embodiments of the present invention are directed to a method for grasping a cylindrical container. The method commences with (a) providing a grasping apparatus comprising a main stage and three clamps. Each of the clamps is pivotally attached to the main stage and rotatable about a respective axis of rotation, wherein the axes of rotation of the clamps define an outer circle having a center, each of the clamps comprising a generally planar body and an arcuate edge. The arcuate edge comprises, in serial order: a first contact section; a first single tooth; a second contact section; a second single tooth; a third contact section; a third single tooth; and a fourth contact section. Each of the first, second and third teeth has a tip with a leading edge and a trailing edge, the leading edge and trailing edge defining an effective tooth profile angle of between about 70 and 100 degrees. The method continues with the steps of: (b) positioning a cylindrical container on the main stage; and (c) rotating the clamps to grasp the container. The first, second, and third teeth are located on the arcuate edge such that the container is engaged by three first teeth, three second teeth, or three third teeth. The first, second and third teeth are configured and oriented on the arcuate edge such that, when the container is engaged by the tips of three first, second or third teeth, the tip of each contacting tooth forms an advance contact angle with a tangent line from its contact point with the container and the leading edge of the tip of between about 68 and 105 degrees.

As a fifth aspect, embodiments of the present invention are directed to a method for securing a cap on a cylindrical container. The method begins with (a) providing a grasping apparatus comprising a main stage and three clamps, each of the clamps pivotally attached to the main stage and rotatable about a respective axis of rotation. The axes of rotation of the clamps define an outer circle having a center. Each of the clamps comprises a generally planar body and an arcuate edge, wherein the arcuate edge comprises, in serial order: a first contact section; a first single tooth; a second contact section; a second single tooth; a third contact section; a third single tooth; and a fourth contact section. The method continues with the steps of: (b) rotating the first, second and third clamps to center a cap positioned on the main stage, wherein rotation of the first, second and third clamps forces the cap to a center position on the main stage while contacting the cap with one of the first, second or third teeth of not more than one of any of the first, second or third clamps at any time during rotation; (c) removing the centered cap from the main stage; (d) rotating the first, second and third clamps to grasp a container in the center of the main stage with three of the first teeth, second teeth or third teeth from each of the three clamps; (e) positioning the cap atop the container; and (f) rotating the grasped container relative to the cap to secure the cap on the container.

DETAILED DESCRIPTION OF EMBODIMENTS OF THE INVENTION

Figure 1:
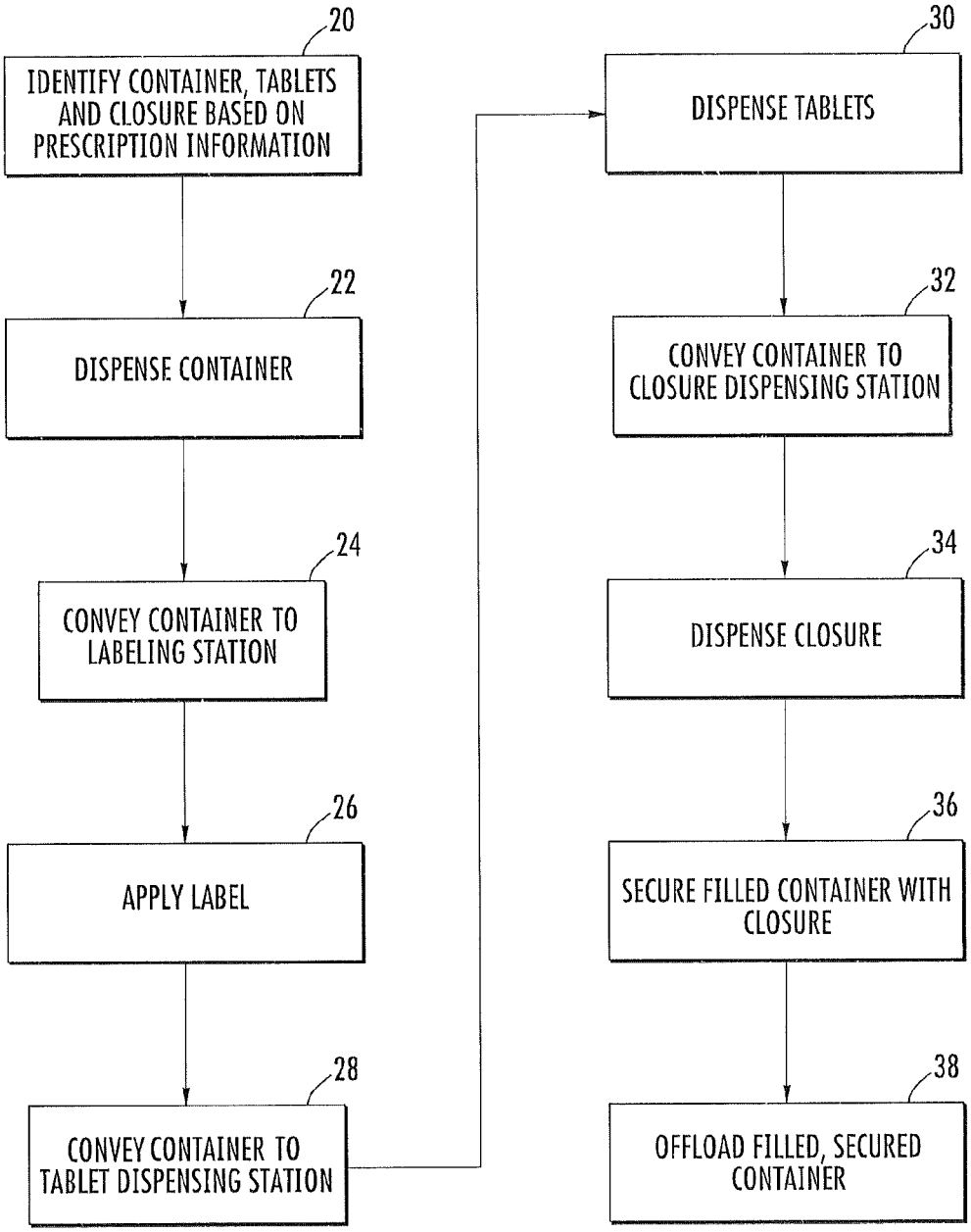
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Also, as used herein, the terms "cap" and "closure" are used interchangeably to refer to a component that caps or closes a pharmaceutical vial.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then moved to a labeling station (Box 24). The labeling station applies a label (Box 26), after which the container is transferred to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
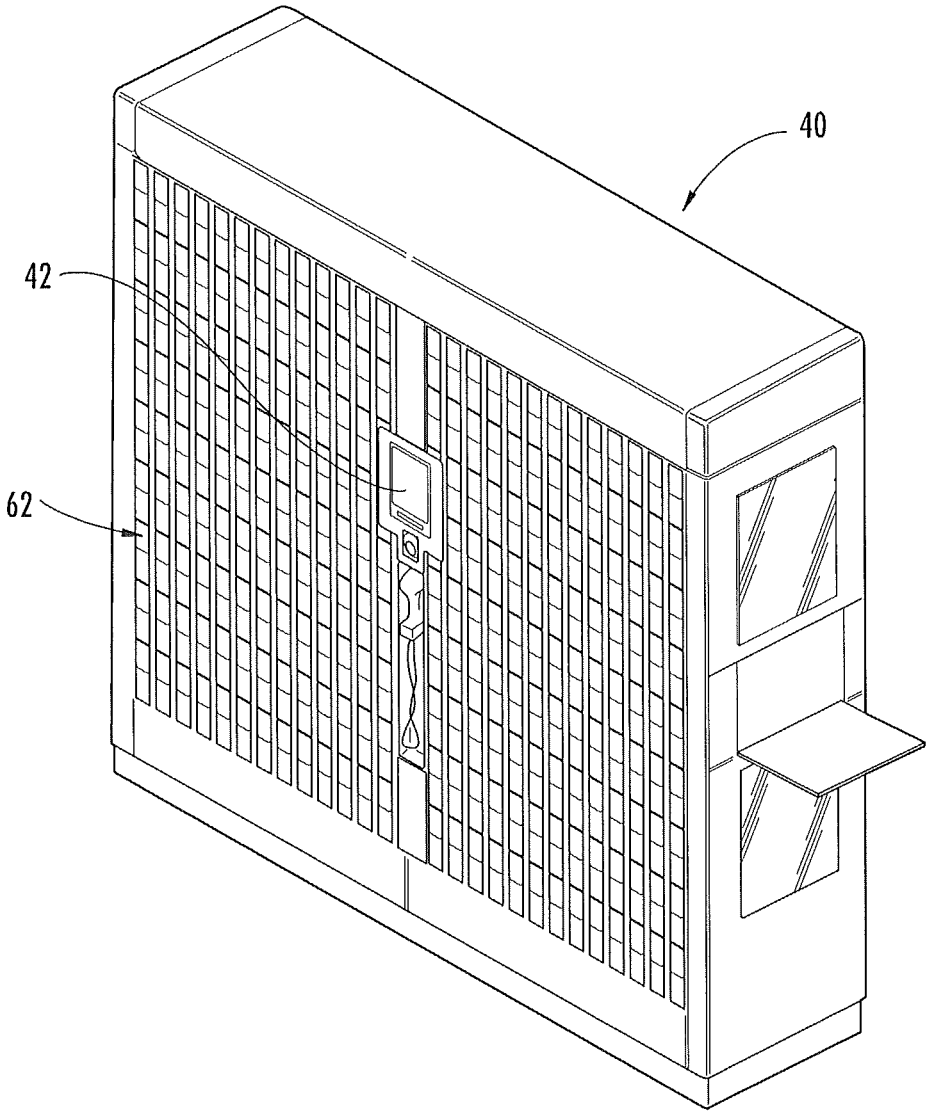
FIG. 2 is a perspective view of a pharmaceutical tablet dispensing system according to the present invention.
Figure 3:
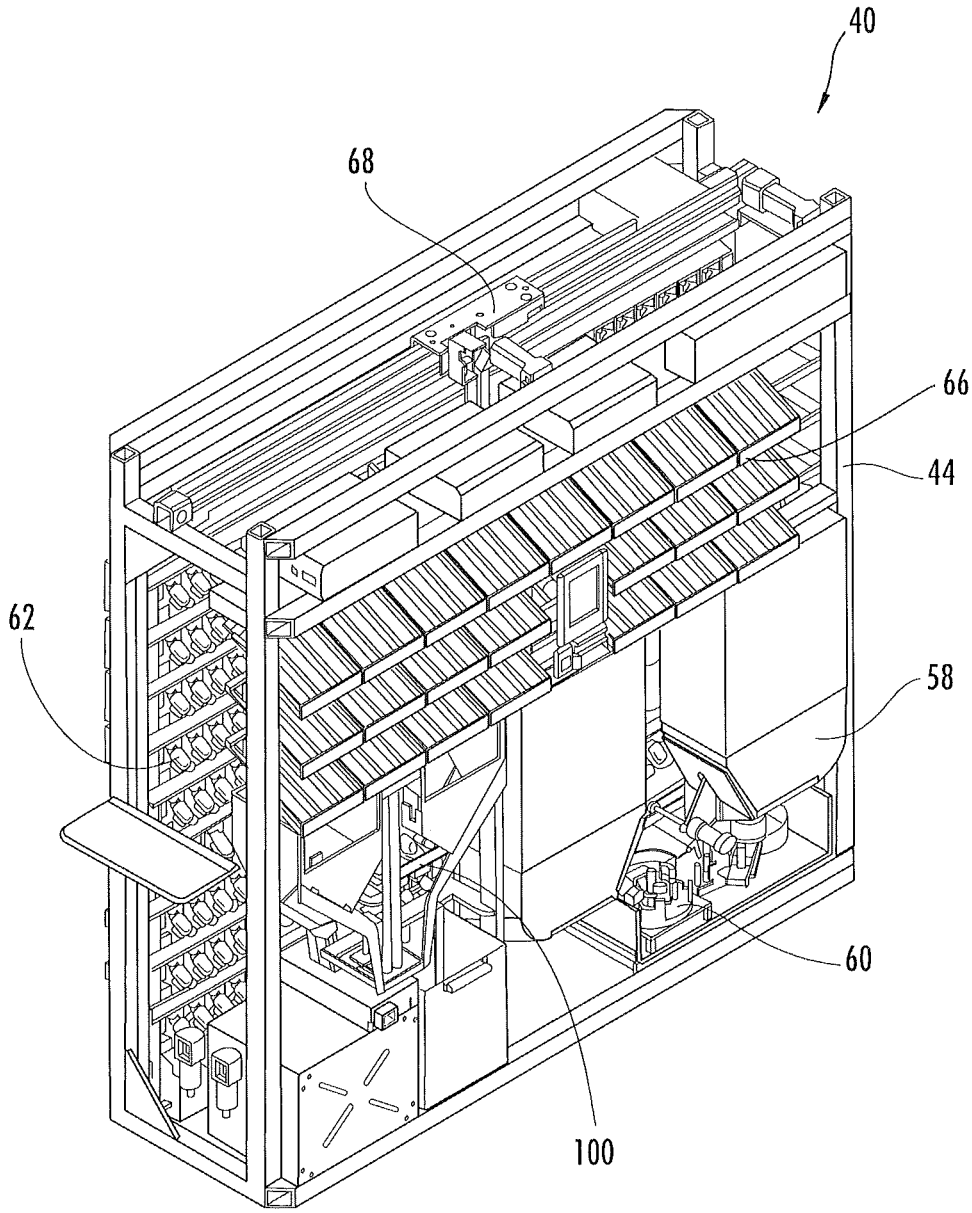
FIG. 3 is a cutaway reverse perspective view of the system of FIG. 2 illustrating the support frame, the container dispensing station, the carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure station 100, and an offloading station 66. In the illustrated embodiment, containers, tablets and closures are moved between these stations with a single carrier 68; however, in some embodiments additional carriers may be employed. With the exception of the closure station 100, which is described in detail below, each of the other operative stations and the conveying devices is described in detail in U.S. Pat. No. 6,971,541 to Williams et al., U.S. patent application Ser. Nos. 11/599,526; 11/599,576; 11/755,249; and 11/927,865, the disclosure of each of which is hereby incorporated herein in its entirety.

Figure 4:
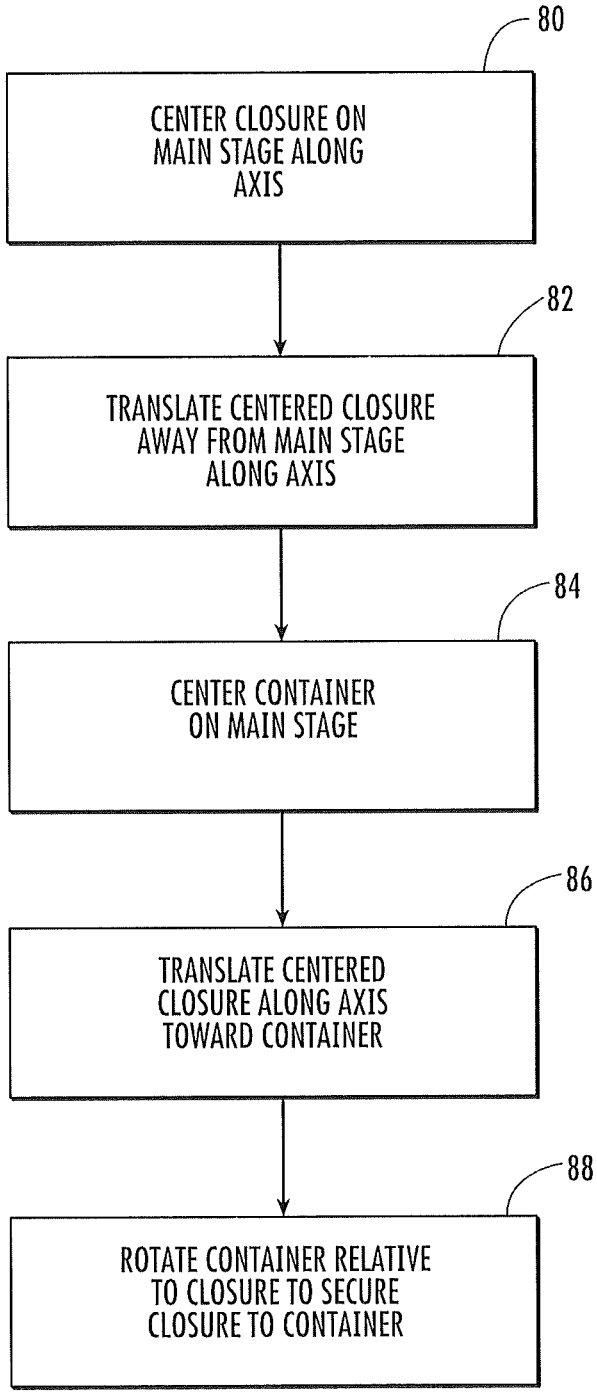
FIG. 4 is a flow chart illustrating an embodiment of a method of applying a closure to a filled vial according to embodiments of the present invention.

Referring now to FIG. 4, general operations of the closure station 100 are illustrated in the form of a flow chart. According to embodiments of the present invention, a closure is centered along an axis at a first position (Block 80), then translated along that axis to a second position (Block 82). A filled vial or other container is then centered along the axis (Block 84). The centered closure is translated along the axis to a third position adjacent the container (Block 86), and the container is rotated relative to the closure about the axis to secure the closure to the container (Block 88). This method can assure that the closure and container are both centered about the same axis, which in turn can improve the reliability of the process of securing the closure onto the container.

Figure 5:
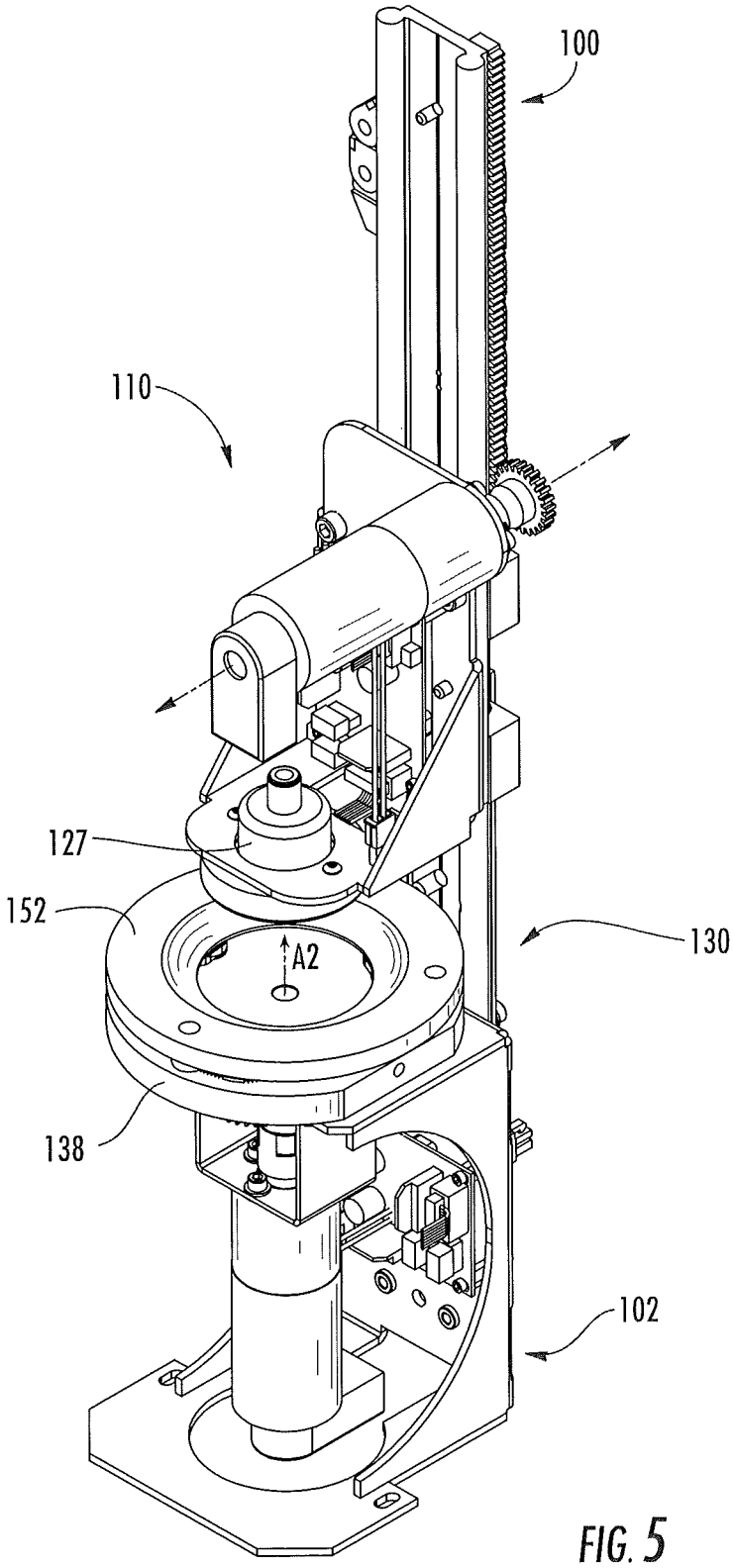
FIG. 5 is a perspective view of a prior art closure station for the system of FIG. 2 shown in a lowered position.
Figure 6:
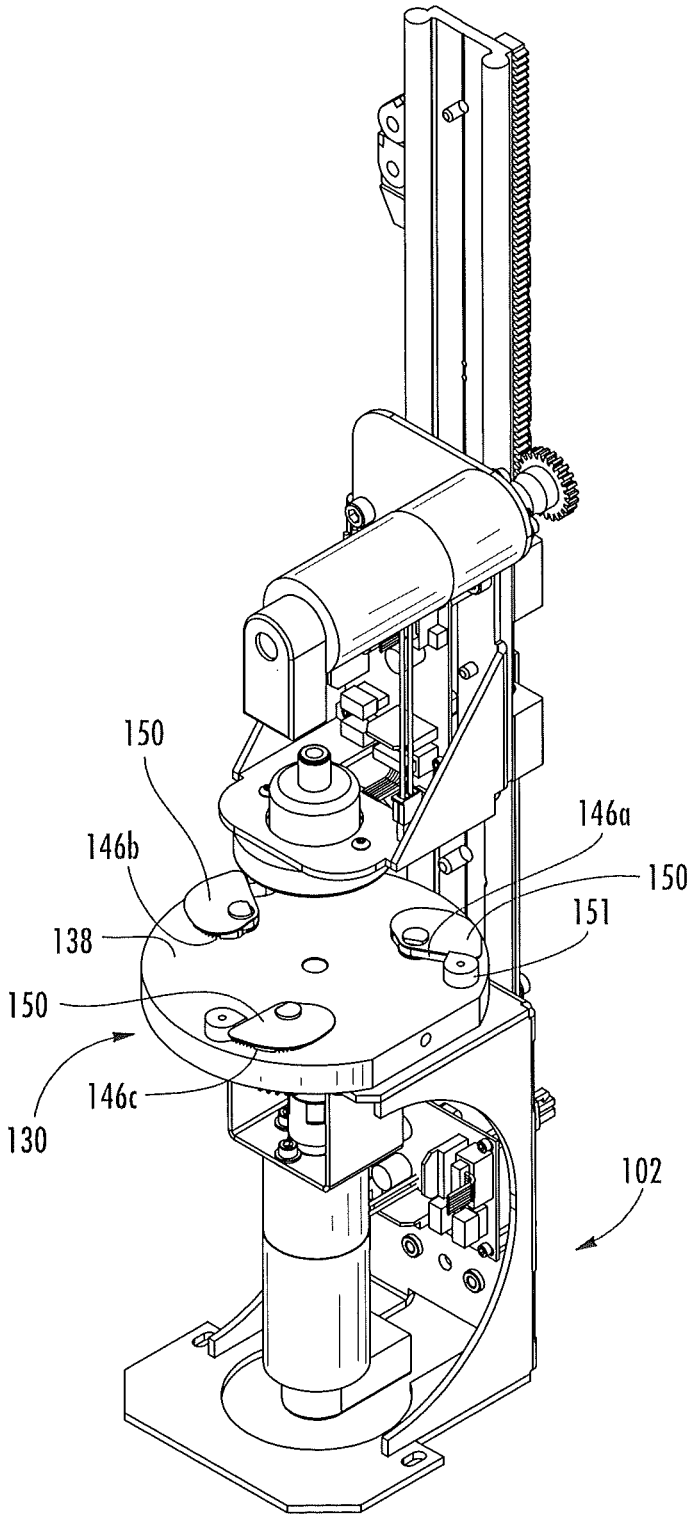
FIG. 6 is a perspective view of the closure station of FIG. 5 in a lowered position with the upper stage removed.

Referring now to FIG. 5, the basic structure of the closure station 100 (which is capable of carrying out the method described in FIG. 4) is illustrated therein. The structure and function of the closure station 100 are described in considerable detail in U.S. Pat. No. 7,581,373, the disclosure of which is hereby incorporated herein in its entirety, and will only be described generally herein. The closure station includes a frame 102, an elevator 110 attached to the frame, and a centering assembly 130 that is also mounted to the frame. The elevator 110 can be raised and lowered relative to the centering assembly 130 and includes a suction block 127 through which suction can be applied. The centering assembly 130 has a circular main stage 138 and an annular upper stage 152 that are rotatable relative to the frame 102. Three clamps 146*a*, 146*b*, 146*c* are rotatably mounted to the main stage 138 at the same radial distance from the center of the main stage 138.

Figure 7:
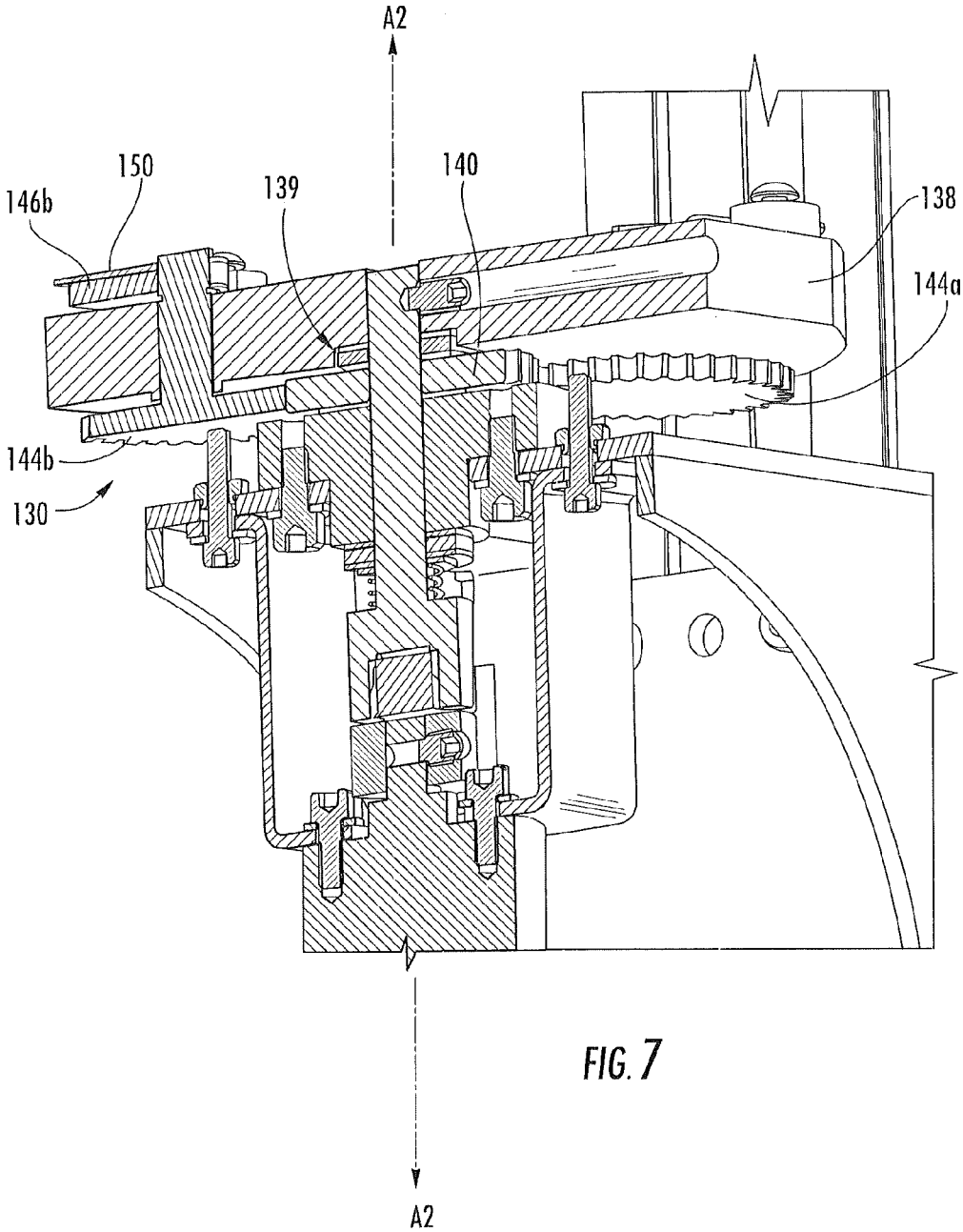
FIG. 7 is an enlarged bottom perspective section view of the main stage and drive assembly of the closure station of FIG. 5.
Figure 8:
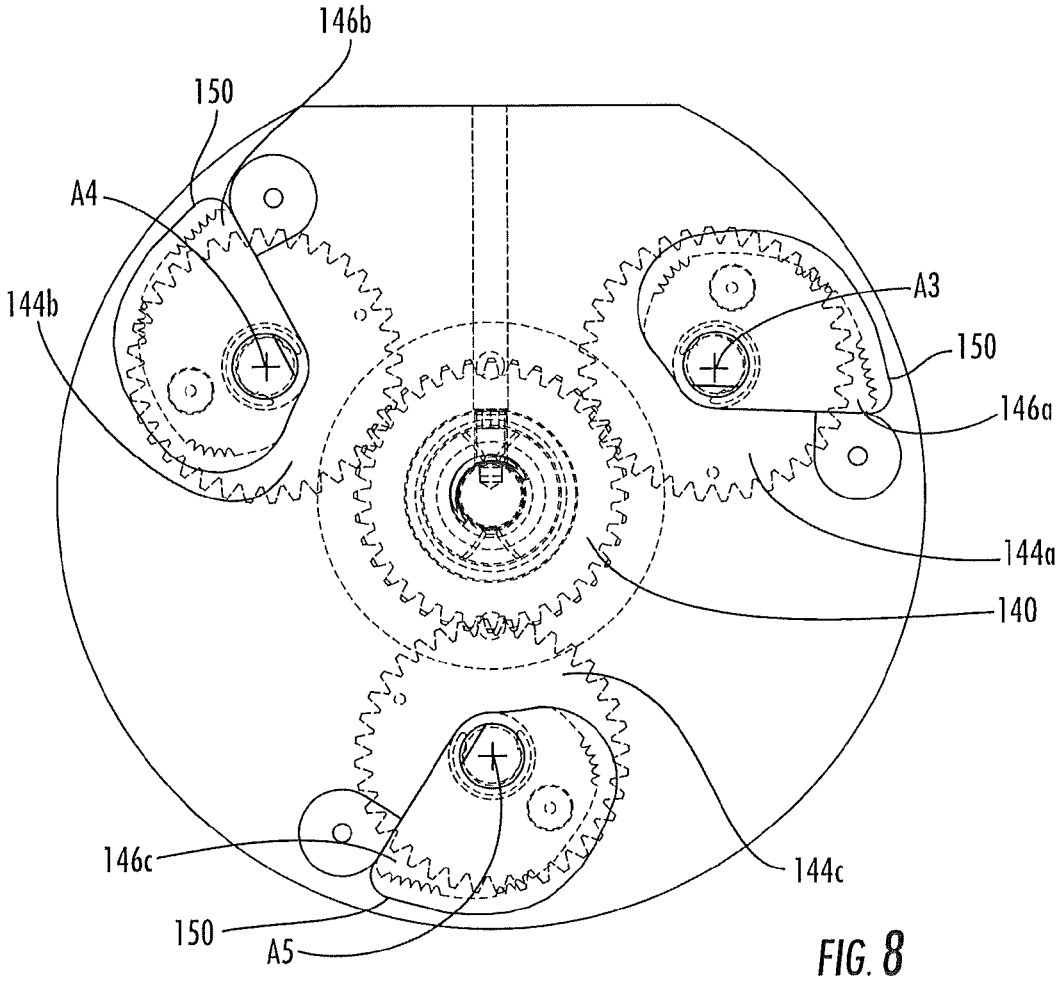
FIG. 8 is a top view of the main stage of the closure station of FIG. 5 with the upper stage removed.

Referring now to FIGS. 7 and 8, each of the clamps 146*a*, 146*b*, 146*c* is fixed to a respective clamp gear 144*a*, 144*b*, 144*c* that in turn engages a central sun gear 140. The sun gear 140 is mounted relative to the main stage 138 such that an intervening clutch mechanism 139 permits or prevents rotation of the sun gear 140 relative to the main stage 138, with the result that under certain pressure conditions the sun gear 140 remains stationary as the main stage 138 rotates, and under other pressure conditions the sun gear 140 rotates with the main stage 138. The structure and function of the clutch mechanism is described in detail in U.S. Pat. No. 7,581,373, supra, and need not be described herein. Rotation of the main stage 138 causes the clamps 146*a*, 146*b*, 146*c* to rotate about their respective axes A3, A4, A5 (see FIG. 8), with their direction of rotation dependent on the rotative direction of the main stage 138 and whether or not the sun gear 140 is engaged via the clutch mechanism 139 for rotation with the main stage 138 or is disengaged and remains stationary.

Figure 9:
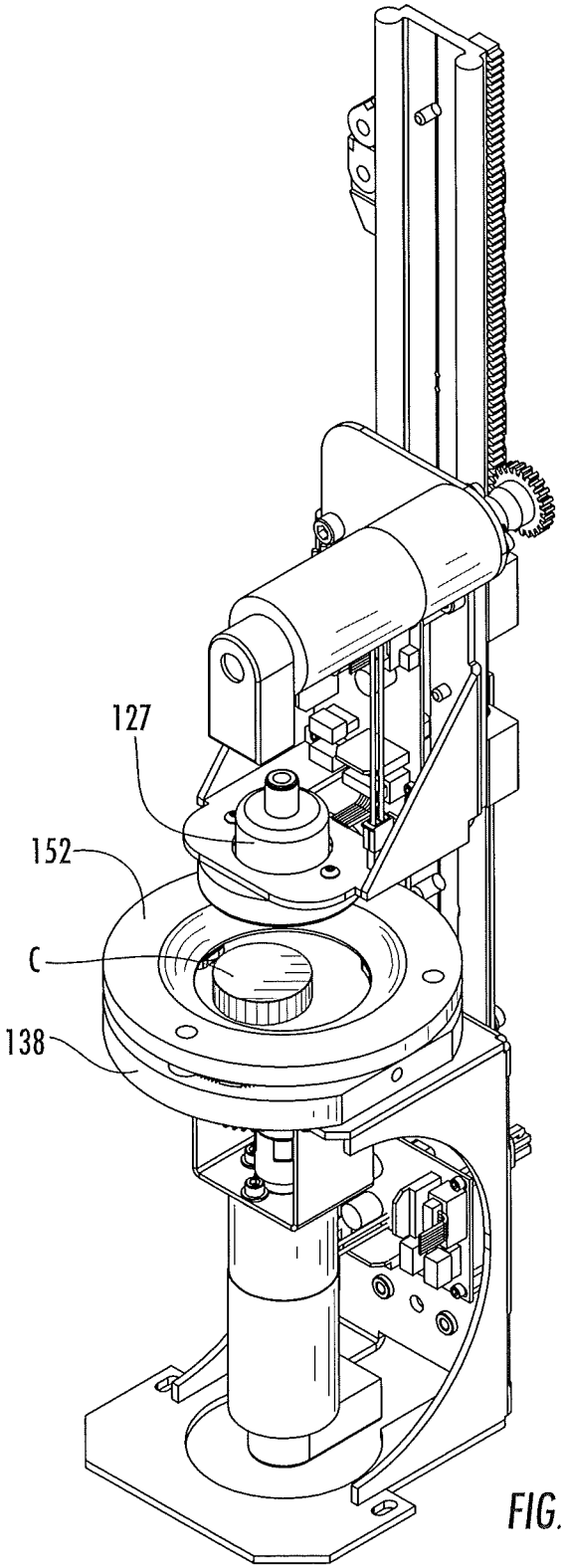
FIG. 9 is a perspective view of the closure station of FIG. 5 showing the reception of a closure, with the elevator in an intermediate position.
Figure 10:
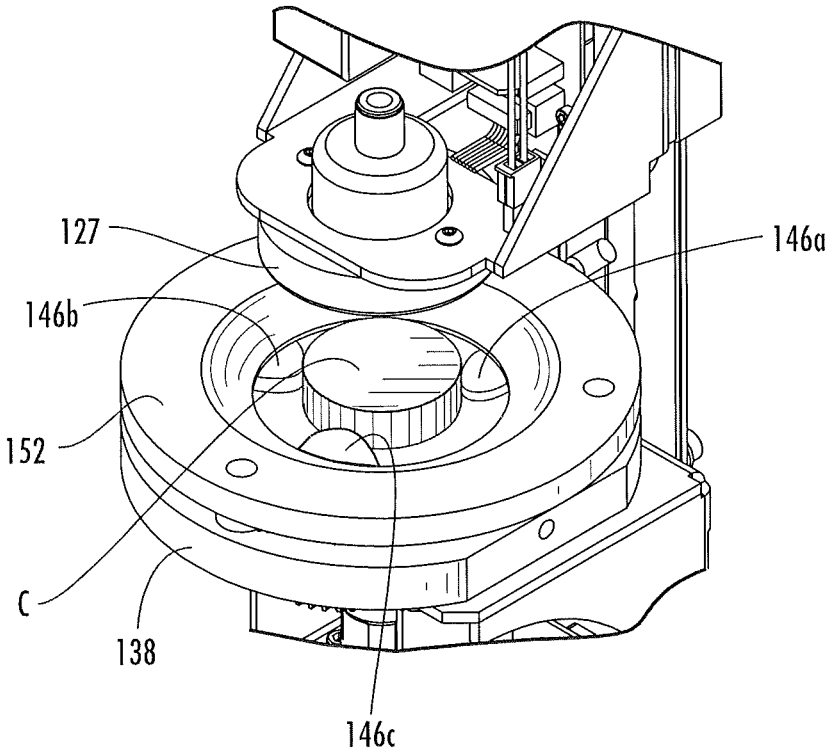
FIG. 10 is an enlarged perspective view of the closure station of FIG. 5 showing the clamping of a closure.
Figure 11:
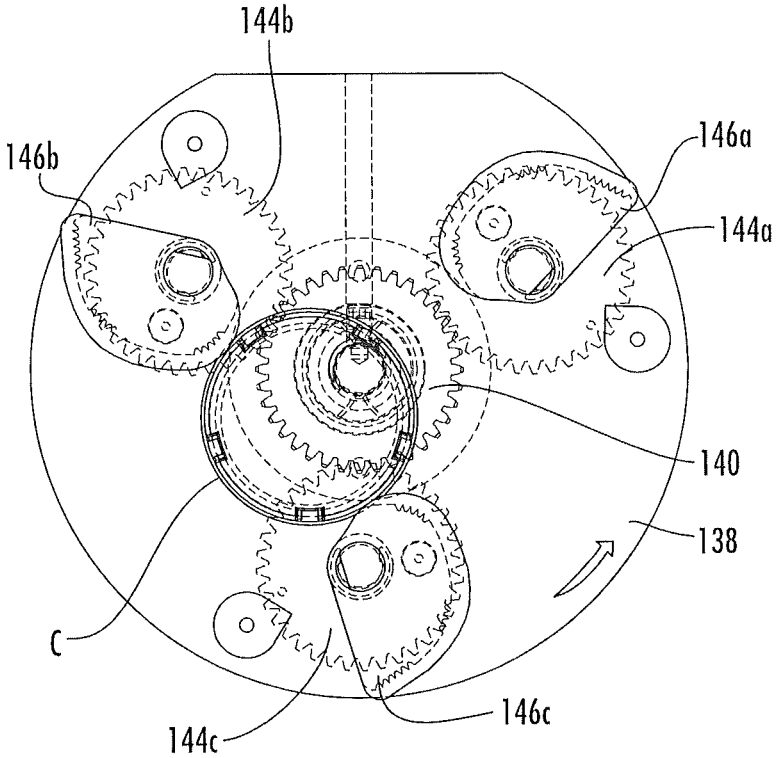
FIG. 11 is a top view of the main stage of the closure station of FIG. 5 with the upper stage removed and the sun and clamp gears visible, wherein the clamps and shields are closing on a closure.
Figure 12:
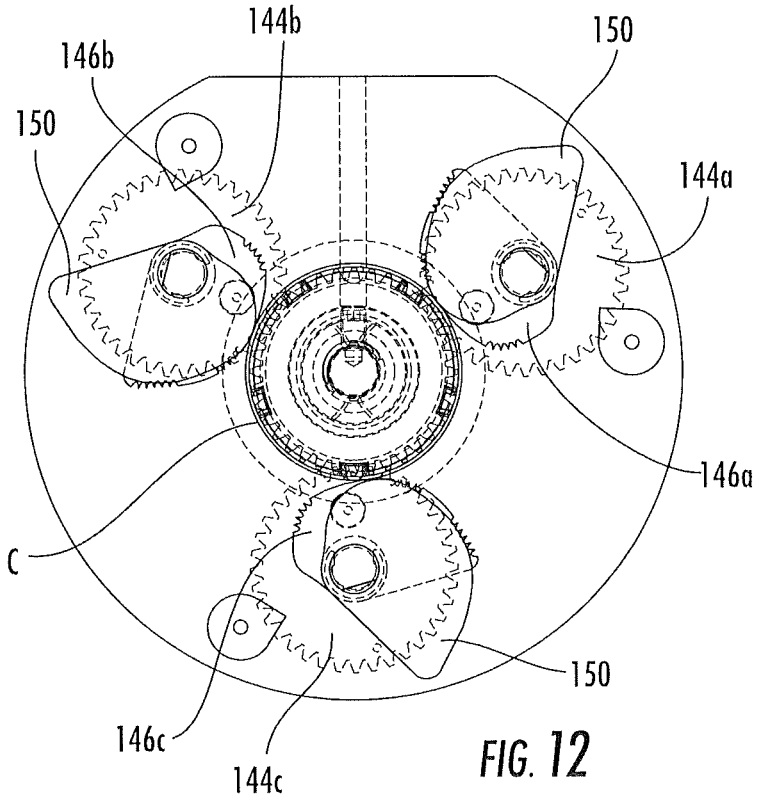
FIG. 12 is a top view of the main stage of the closure station of FIG. 5 with the upper stage removed showing the clamps and shields closed on a closure.
Figure 13:
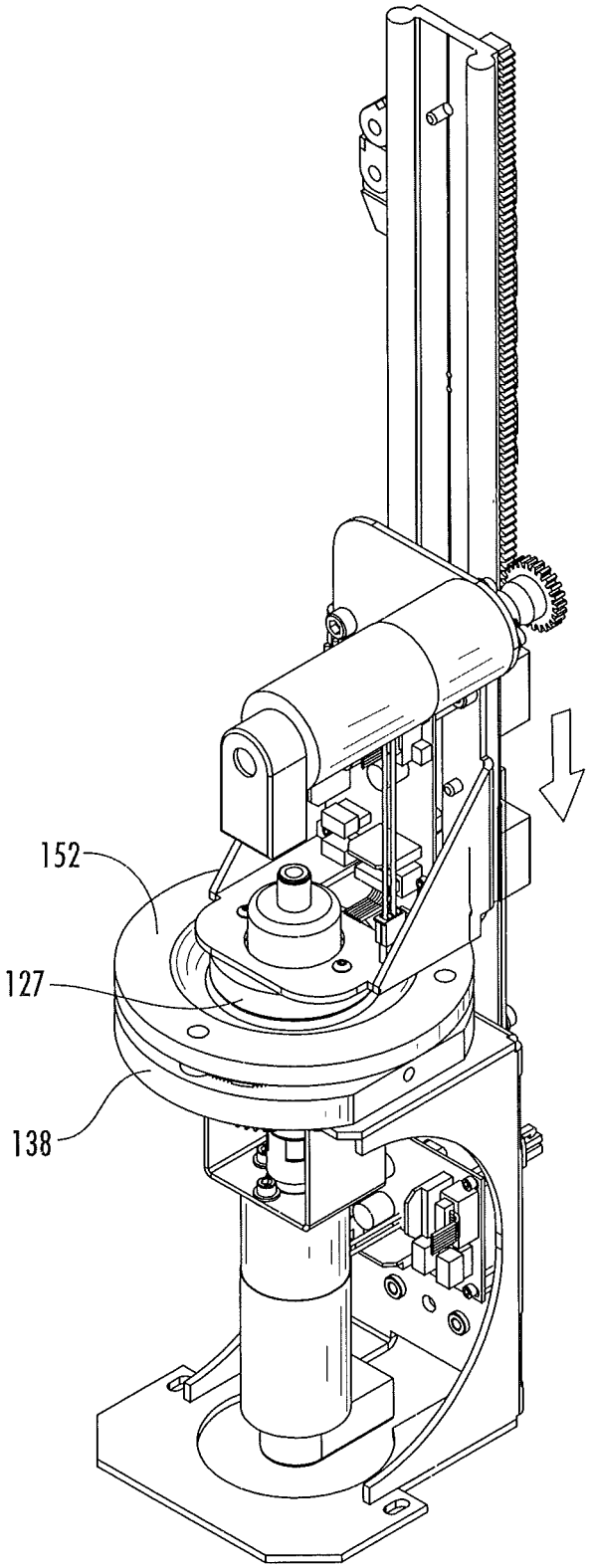
FIG. 13 is a perspective view of the closure station of FIG. 5 showing the elevator capturing the closure.
Figure 14:
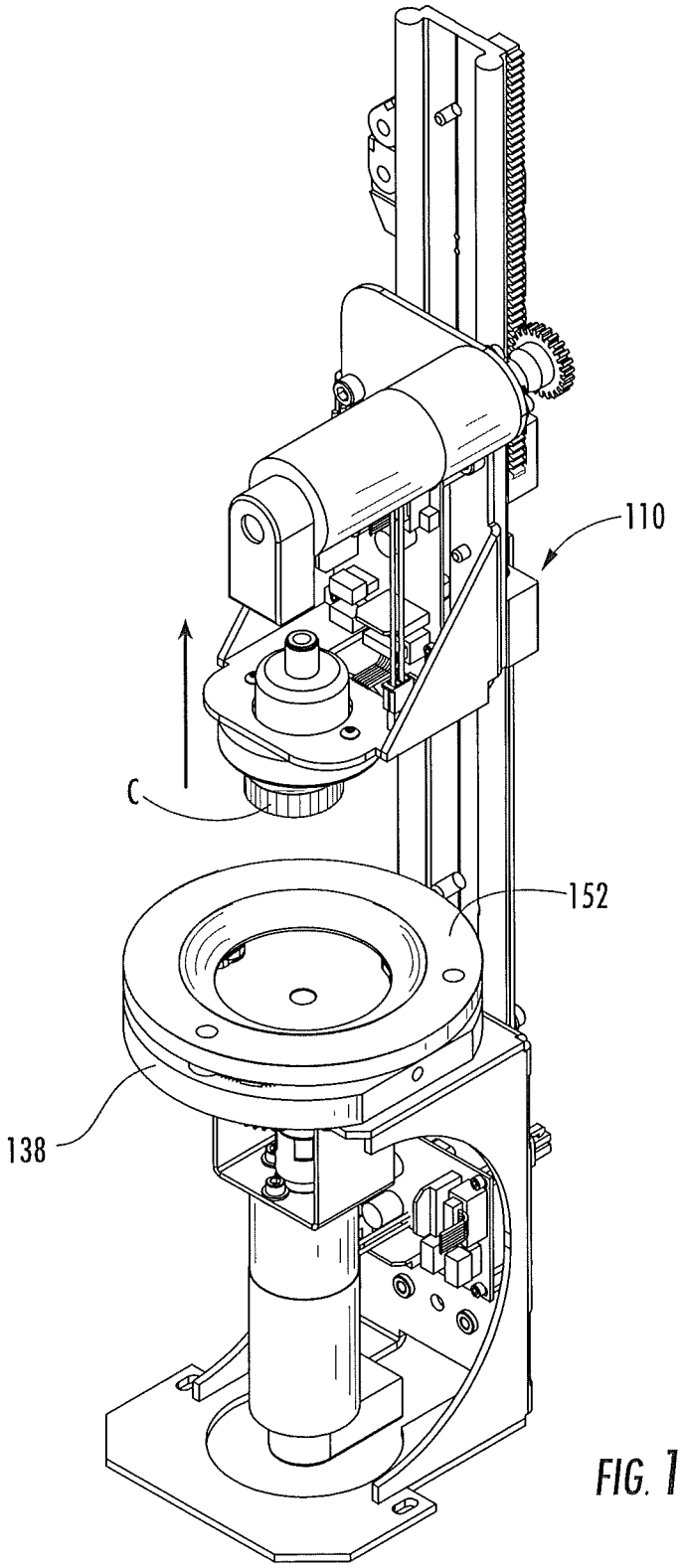
FIG. 14 is a perspective view of the closure station of FIG. 5 showing the elevator and closure in a raised position.
Figure 15:
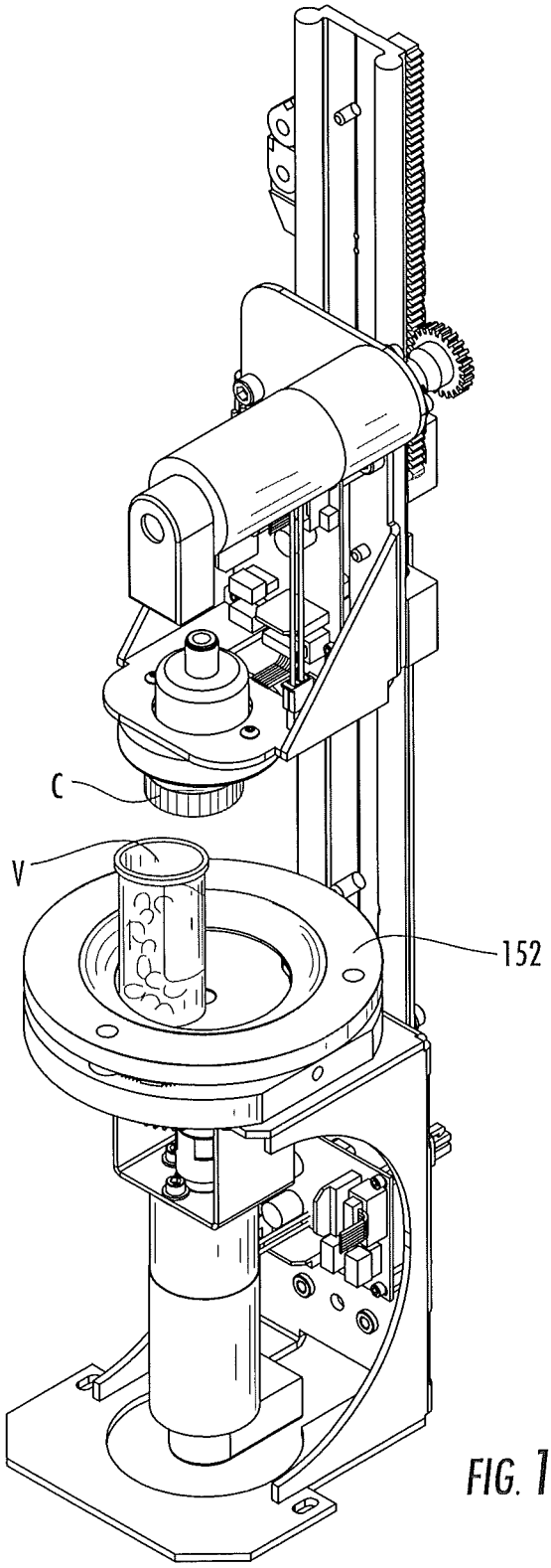
FIG. 15 is a perspective view of the closure station of FIG. 5 showing the receipt of a filled vial on the main stage.
Figure 16:
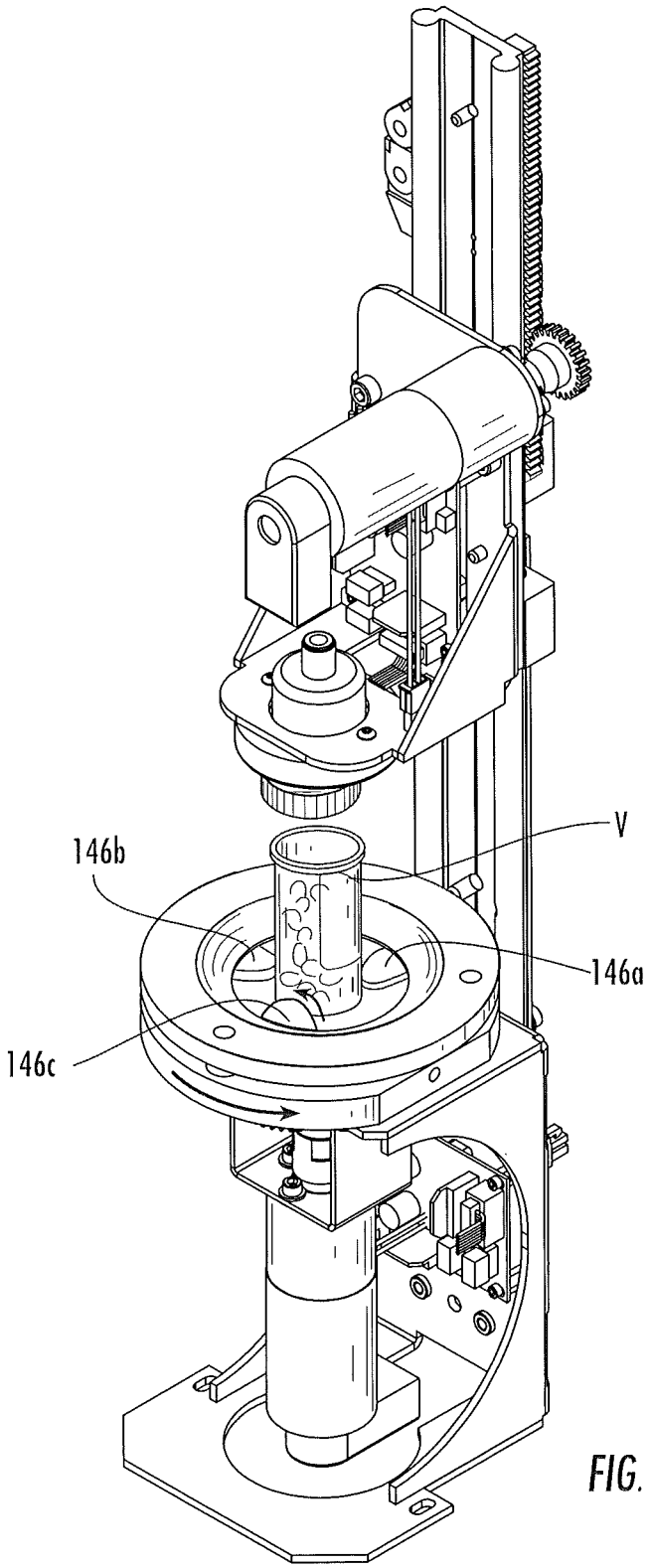
FIG. 16 is a perspective view of the closure station of FIG. 5 showing the operating of the clamps to center the filled vial.
Figure 17:
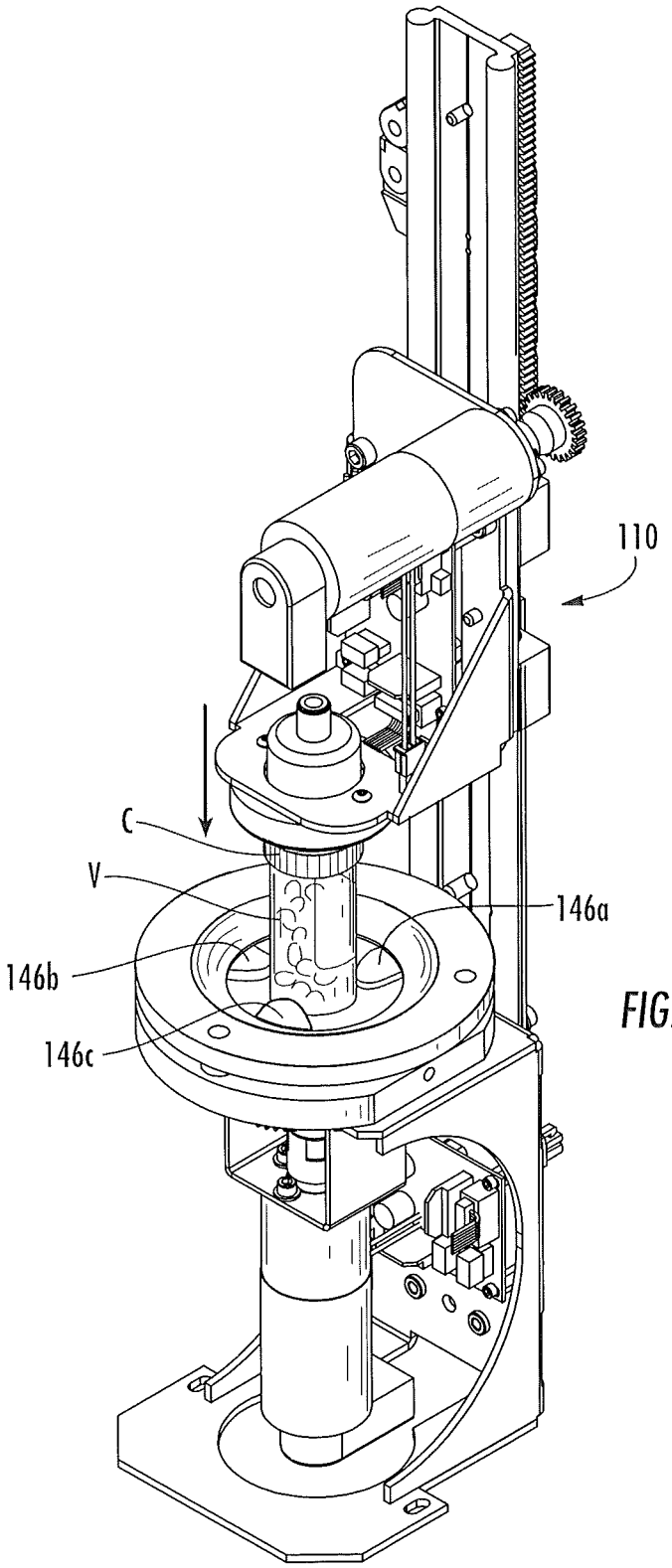
FIG. 17 is a perspective view of the closure station of FIG. 5 showing the lowering of the elevator to deposit the closure on the filled vial.
Figure 18:
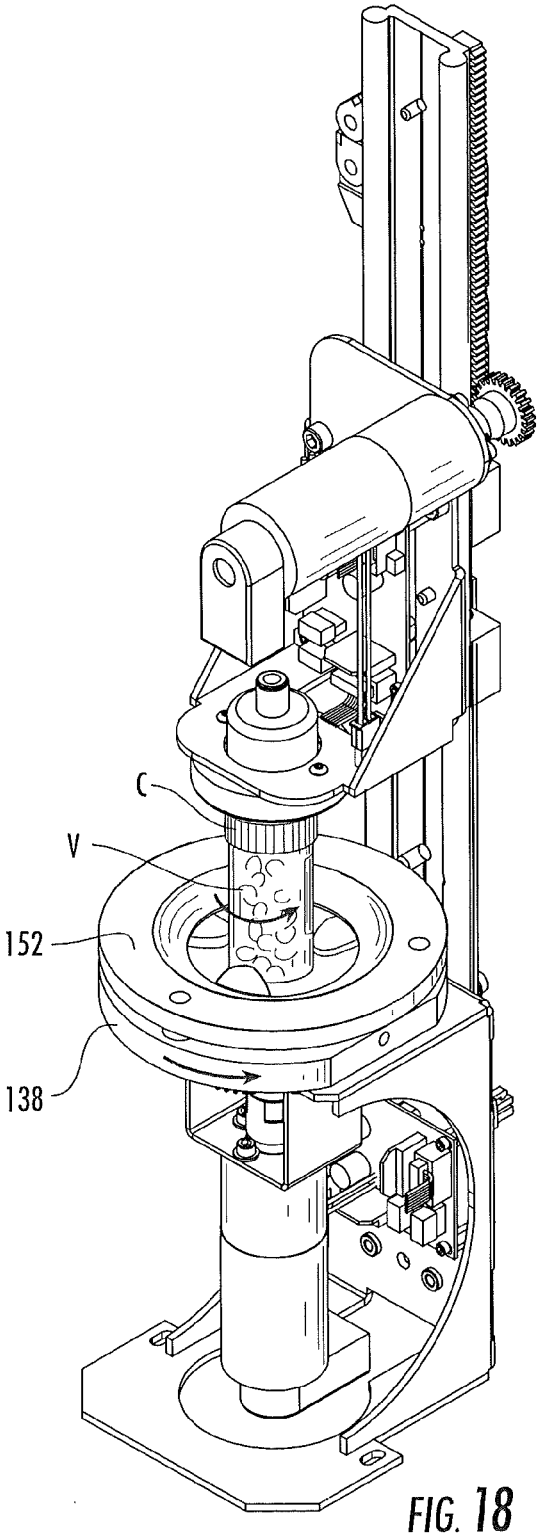
FIG. 18 is a perspective view of the closure station of FIG. 5 showing the rotation of the main stage to secure the closure to the filled vial.
Figure 19:
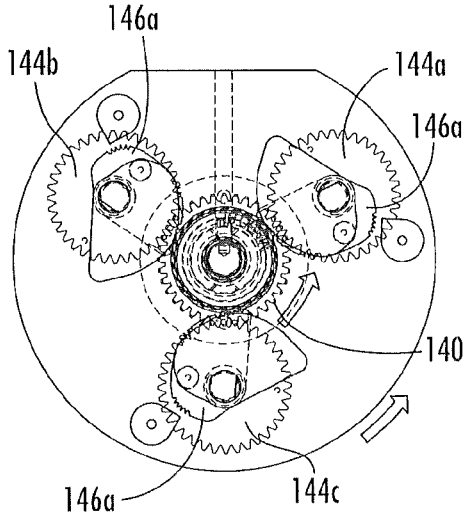
FIG. 19 is a top view showing the positions of the clamps and shields as the sun gear rotates with the main stage while securing a vial with a closure.
Figure 20:
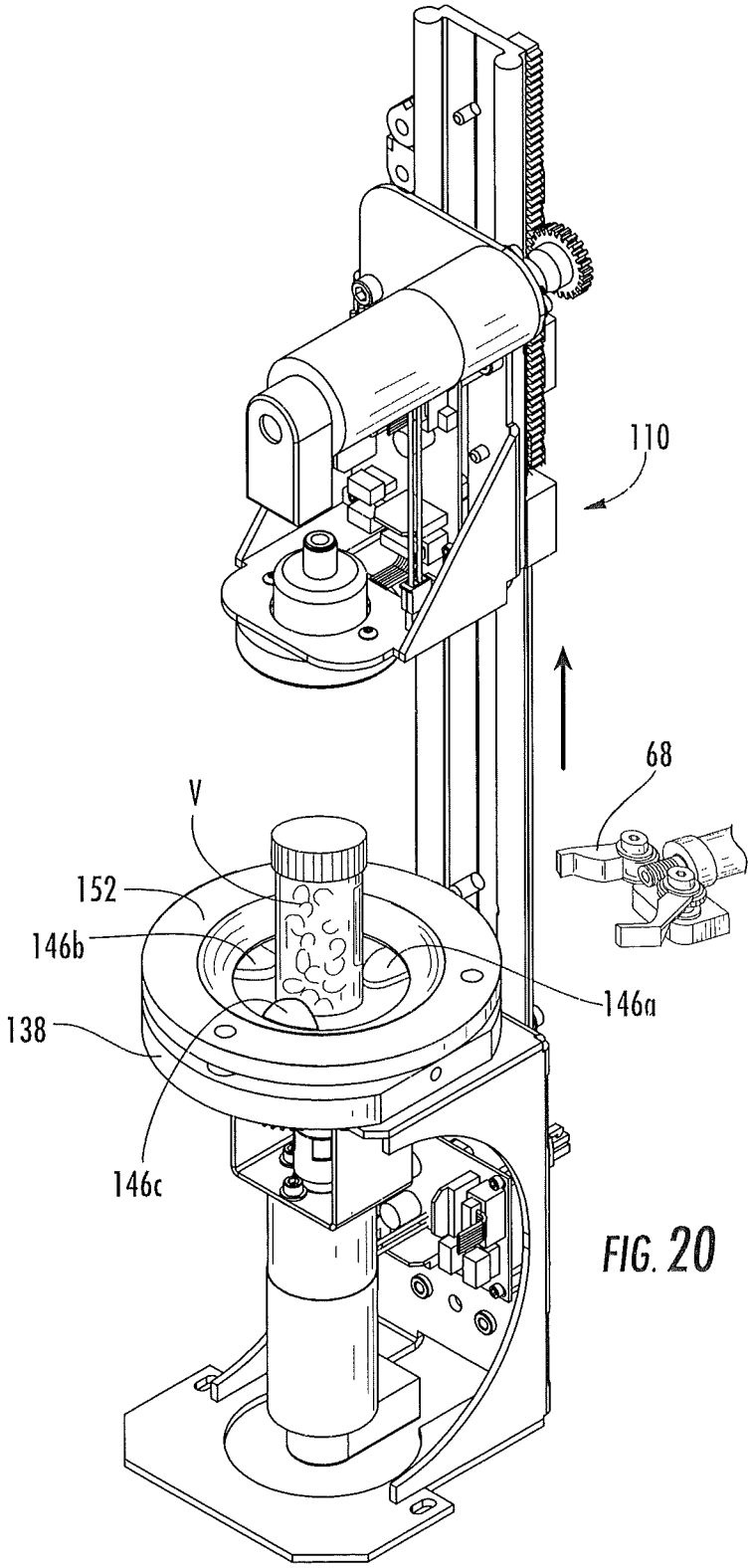
FIG. 20 is a perspective view of the closure station of FIG. 5 showing the elevator in the raised position and the dispensing carrier retrieving the filled, capped vial from the closure station.

As can be seen from FIGS. 9-20, a cap C is deposited on the main stage 138 within the aperture of the upper stage 152 (FIG. 9). The lower stage 138 rotates about an axis A2 (counterclockwise from the vantage point of FIG. 9) but the clutch mechanism 139 does not engage the sun gear 140, which remains stationary. Rotation of the lower stage 138 rotates the clamps 146*a*, 146*b*, 146*c* counterclockwise; the rotation of the clamps 146*a*, 146*b*, 146*c* forces the cap C into the center of the main stage 138 (FIGS. 10-12). The main stage 138 rotates clockwise to retract the clamps 146*a*, 146*b*, 146*c*. The elevator 110 then descends (FIG. 13) and, via suction applied through the suction block 127, lifts the centered cap C from the main stage 138 (FIG. 14). The carrier 68 then deposits a filled vial onto the main stage 138 (FIG. 15). The main stage 138 rotates counterclockwise, which again rotates the clamps 146*a*, 146*b*, 146*c* counterclockwise. Contact between the clamps 146*a*, 146*b*, 146*c* and the vial V centers the vial V (FIG. 16). The elevator 110 lowers the cap C onto the open upper end of the vial V (FIG. 17). The main stage 138 then continues to rotate counterclockwise and the clutch mechanism 139 associated with the sun gear 140 engages, such that the sun gear 140 also rotates and the clamps 146*a*, 146*b*, 146*c* remain in their angular positions gripping the vial V (FIGS. 18 and 19). Rotation of the main stage 138 rotates the vial V relative to the cap C, which rotation screws the cap C onto the vial V. Once the cap C is secured, the elevator 110 relaxes its suction and rises away from the main stage 138 (FIG. 20), the main stage 138 rotates clockwise to release the clamps 146*a*, 146*b*, 146*c*, and the carrier 68 returns to grasp the vial V and convey it to the offloading station 66 or the like.

In the capping station 100 described in U.S. Pat. No. 7,581,373, supra, the vial/cap clamps 146*a*, 146*b*, 146*c* include shields 150 on their upper surfaces in order to prevent snagging of the caps C during centering (the shields 150 can be seen in FIGS. 7 and 8). A cap C is particularly susceptible to snagging when it is deposited between two clamps (such as is shown in FIG. 11), and in the course of rotating to push the cap C to a centered position, the teeth of two clamps 146*b*, 146*c* engage the cap C at the same time. This arrangement can cause the cap to "lock" between the clamps 146*b*, 146*c* rather than sliding toward the center of the main stage 138. The shields 150 are included to protect the cap C from exposure to the teeth of the clamps 146*a*, 146*b*, 146*c* until the cap C reaches a generally centered position in which snagging is less likely. Although the shields 150 are generally successful in performing this function, each shield 150 represents an additional component, so for the purposes of cost and component number reduction, it may be desirable to provide a design for the clamps that eliminates the need for the shields 150.

Figure 21:
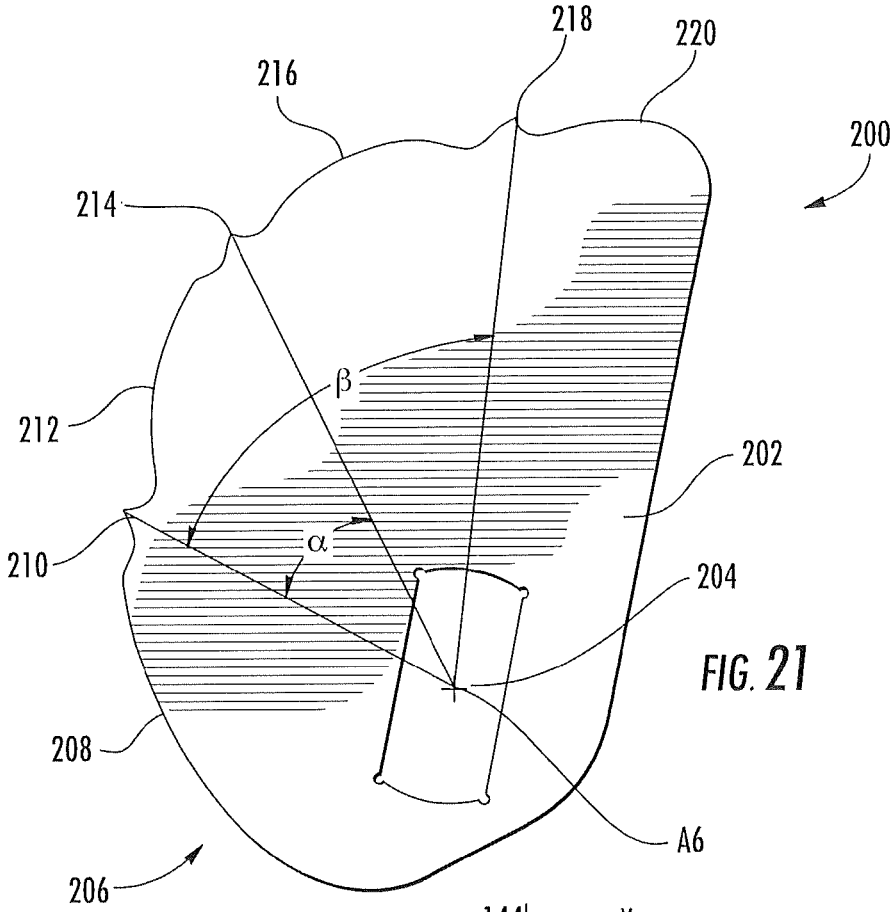
FIG. 21 is a greatly enlarged top view of a clamp for use in a closure station according to embodiments of the present invention.

Turning now to FIG. 21, a clamp, designated broadly at 200, is illustrated therein. Three clamps 200 can be substituted in place of the clamps 146*a*, 146*b*, 146*c* and shields 150 in the closure station 100.

The clamp 200 includes a body portion 202, an oblong pivot aperture 204, and a contact edge 206. The contact edge 206, which describes generally an arc of increasing radius, can be subdivided into multiple sections: a first contact section 208; a first single tooth 210; a second contact section 212; a second single tooth 214; a third contact section 216; a third single tooth 218; and a fourth contact section 220. Using the center of the pivot aperture 204 (denoted as axis A6) as a reference point, the radius of the contact edge 206 increases from about 0.50 inches in the first contact section 208 to about 1.1 inches in the fourth contact section 220. More specifically, the radius from the axis A6 to the tooth 210 is about 0.58 to 0.60 inches, the radius from the axis A6 to the tooth 214 is about 0.78 to 0.81 inches, and the radius from the axis A6 to the tooth 218 is about 0.89 to 0.91 inches. The tip of the first tooth 210 is spaced from the tip of the second tooth 214 by an arc $\alpha$ of between about 33 and 38 degrees and from the third tooth by an arc $\beta$ of between about 65 and 70 degrees.

Figure 23:
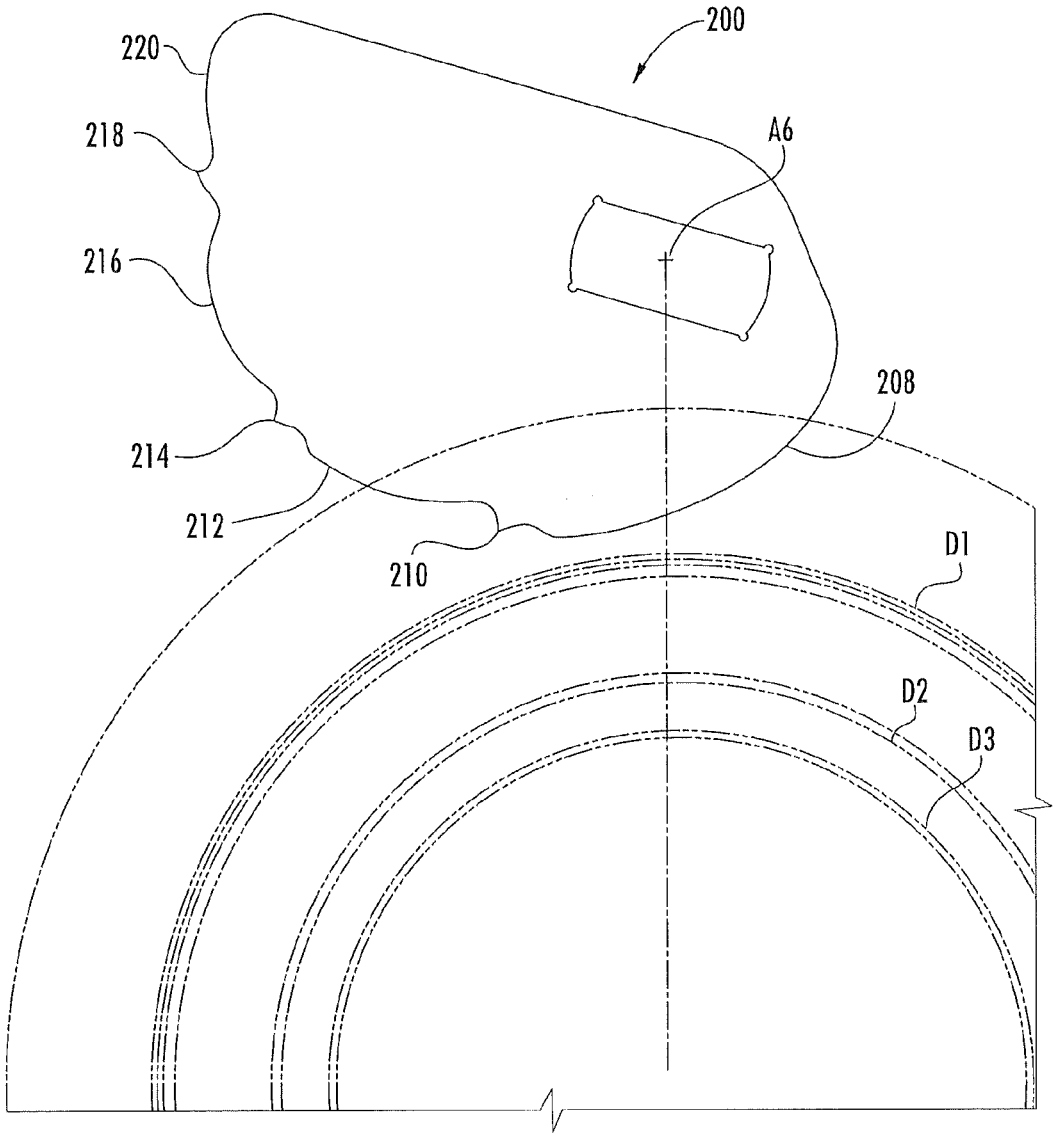
FIG. 23 is a schematic diagram illustrating how the clamp of FIG. 21 can be employed to grip vials of eight different diameters.
Figure 23A:
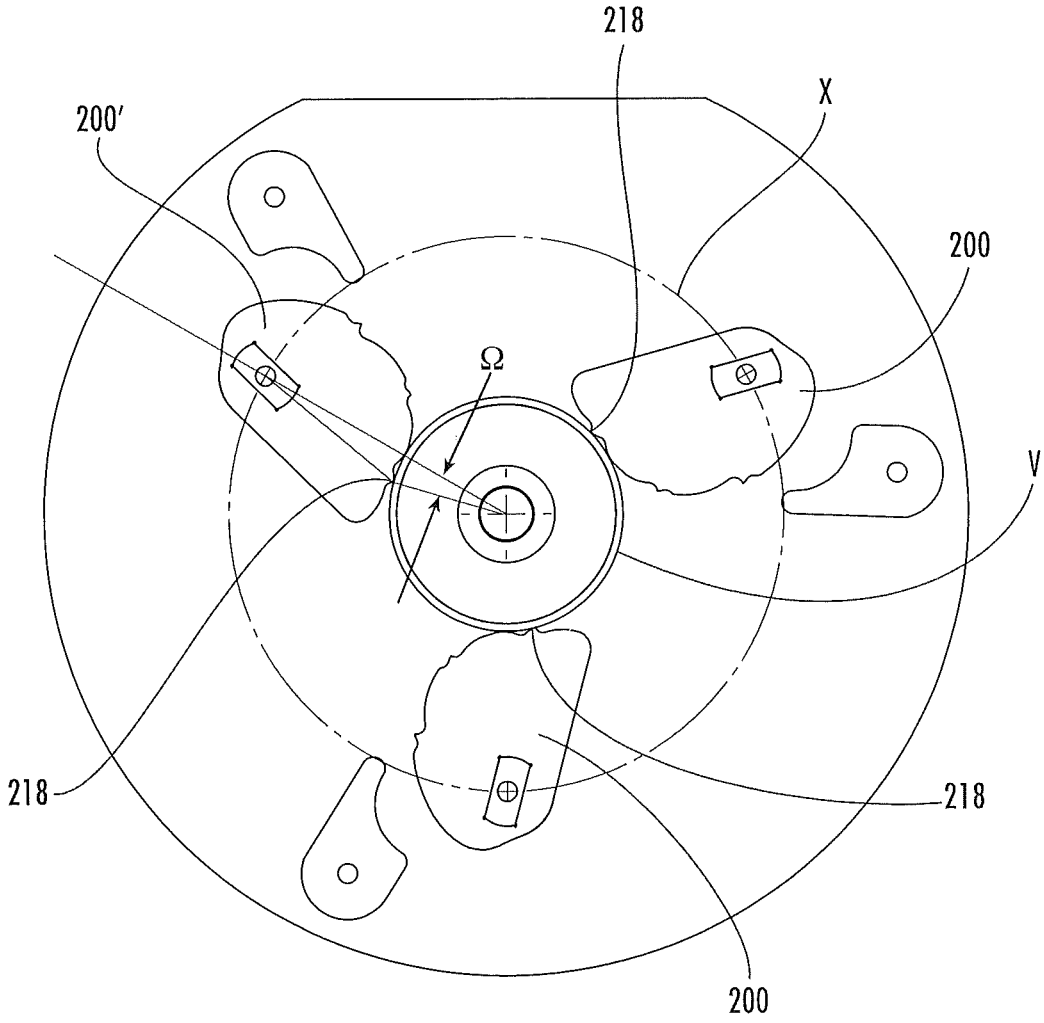
FIG. 23A is a top view of the closure station of FIG. 21 grasping a vial with three clamps.
Figure 23B:
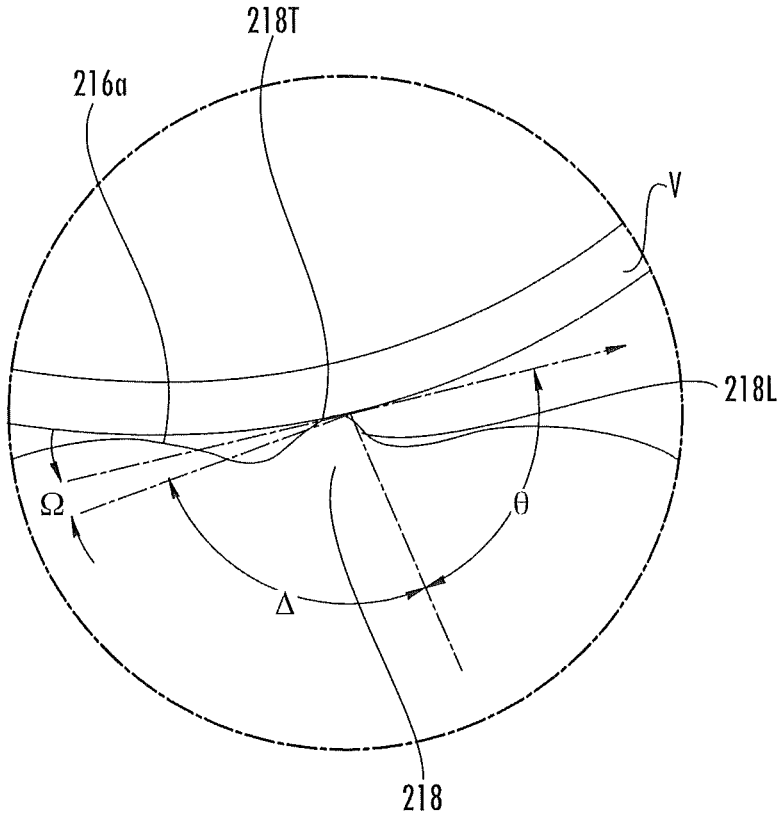
FIG. 23B is a greatly enlarged top view of a tooth of a clamp engaging a vial.

The geometric profile of the teeth 210, 214, 218 may also be varied and controlled. Referring now to FIG. 23B, each of the teeth 210, 214, 218 can be defined in terms of an effective tooth profile angle $\Delta$ and an advance contact angle $\theta$ (FIG. 23 illustrates only tooth 218). The effective tooth profile angle $\Delta$ represents the "sharpness" of the tooth and is defined by the leading edge 218L and the trailing edge 218T of the tooth. In practice, as the effective tooth profile angle $\Delta$ increases, the tooth may generate less "bite" into the vial; however, as the effective tooth profile angle $\Delta$ decreases, the risk of a tooth snagging a cap increases. The advance contact angle $\theta$ represents the degree to which the tooth is oriented relative to the surface of the vial and is measured between the leading edge 218L of the tooth and a line that is tangent to the surface of the vial at the contact point. As $\theta$ varies, the "bite" into the vial varies, as does the risk of cap snagging; i.e., as the "bite" increases, the risk of cap snagging also increases. Table 2 below includes exemplary values for $\theta$ and $\Delta$ for the teeth 210, 214, 218.

As shown in FIG. 23B, each of the first, second and third contact sections 208, 212, 216 may include a lobed portion (designated at 216*a* in FIG. 23B). The lobed portion 216*a* is sized and positioned to extend nearly to the vial when its adjacent tooth is gripping the vial (as shown in FIG. 23B). When so configured, the lobed portion 216*a* can "shield" the adjacent tooth from contact with a cap in most orientations of the clamp 200 and can therefore help to prevent snagging.

Also, to generate a relatively high contact force of the teeth 210, 214, 218 on the vial, the relative teeth and corresponding vial locations can be controlled to allow the clamps 200 to perform as largely self-engaging clamps on the vial diameter. This action can be achieved by using a vial contact angle $\Omega$ (see FIG. 23A) that, when all of the clamps 200 are engaged, is sufficiently small to induce the clamps 200 to continue rotation against the vial solely by the application of clockwise torque to the vial. At the same time, the contact angle $\Omega$ is chosen so as not to be so shallow as to allow the teeth 210, 214, 218 to over-travel their contact point with the vial. That is, vectors between the axis A6 and the contact point of the tooth in question are not permitted to rotate to a position which would bring them coincident with a line having endpoints at the vial center and the clamp's axis of rotation A6. In some embodiments, the contact angle $\Omega$ is between about 10 and 20 degrees; in certain embodiments, the contact angle $\Omega$ is between about 13 and 15 degrees.

The dimensions of the clamp 200 are selected in order to provide flexibility to the closure system 100 in dealing with different sizes of caps and vials. For example, the illustrated embodiment is designed to perform on eight different combinations of caps and vials. The specific vial and cap diameters are shown in Table 1.

TABLE 1

| Vial Type | Vial Diameter (in.) | Cap Diameter (in.) |
|---|---|---|
| Rexam Z-40 | 1.926 ± .075 | 2.328 ± .075 |
| Rexam L-30A | 1.902 ± .075 | 2.160 ± .075 |
| Tri-State TS PRX30NCST | 1.880 ± .075 | 2.176 ± .075 |
| Kerr VL-30 | 1.859 ± .075 | 2.259 ± .075 |
| Rexam Z-20A | 1.480 ± .075 | 1.884 ± .075 |
| Tri-State TS PRX13NC | 1.267 ± .075 | 1.513 ± .075 |
| Rexam L-13A | 1.268 ± .075 | 1.509 ± .075 |
| Kerr VL-13 | 1.244 ± .075 | 1.658 ± .075 |

Figure 22:
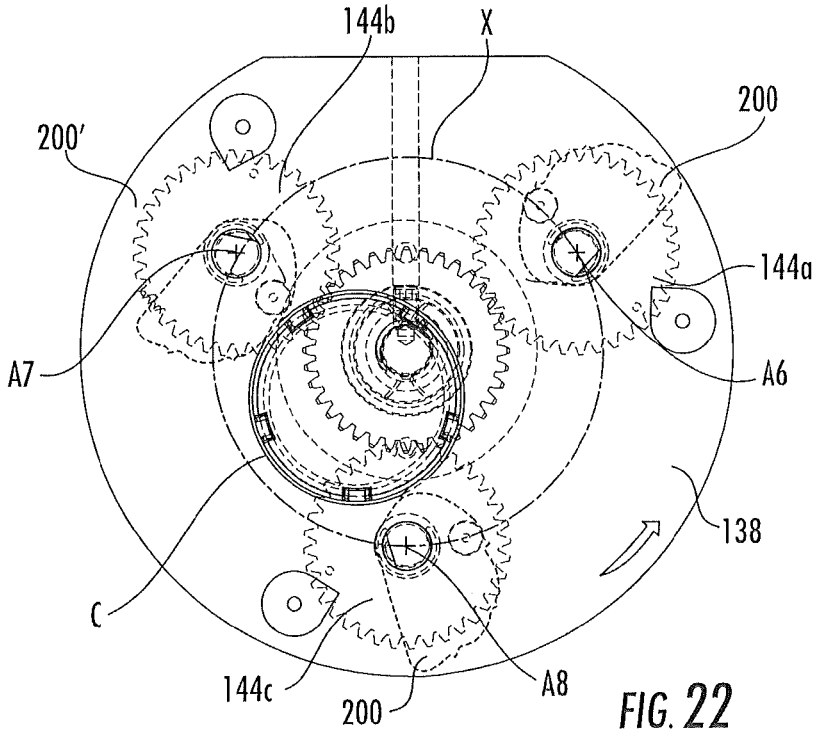
FIG. 22 is an enlarged top view of a closure station employing three clamps of FIG. 21, with two of the clamps contacting a cap to center it.

When mounted (see FIG. 22) on the main stage 138 (typically at positions in which the pivot axes A6, A7, A8 of the clamps 200 define a circle X having a diameter of between about 2.8 and 3.2 inches), the clamp 200 operates much like the clamps 146*a*, 146*b*, 146*c* described above. However, as can be seen in FIG. 22, when a cap C is positioned between two clamps 200, 200', the cap is contacted by no more than one tooth 210, 214, 218 at a time; when a tooth of one clamp 200 engages a cap, the second clamp 200' presents one of the contact sections 208, 212, 216, 220 for engagement. As a result, the cap does not "snag" on the clamps 200, 200', but instead is pushed to the center of the main stage 138 for centering.

Once the cap has been centered and removed and a vial has been deposited, rotation of the clamps 200 causes one of the teeth 210, 214, 218 of each clamp 200 to engage the vial and grip it as it rotates with the main stage 138 to secure the cap. The positions of the teeth 210, 214, 218 are selected such that they present the leading points of contact for each clamp 200 within annuli D1, D2, D3 having the inner and outer diameters as shown in Table 2 (see also FIG. 23), wherein the annuli D1, D2, D3 are concentric with the circle defined by the axes of rotation A6, A7, A8.

TABLE 2

| Tooth | Annulus Inner Diameter (in) | Annulus Outer Diameter (in) | Effective Tooth Profile Angle Δ (degrees) | Advance Contact Angle θ (degrees) | Suitable Vial Types |
|---|---|---|---|---|---|
| 210 | 1.800 | 1.975 | 75-80 | 83-105 | Rexam Z-40, Rexam L-30A, Tri-State TS PRX30NCST, Kerr VL-30 |
| 214 | 1.430 | 1.530 | 90-95 | 70-75 | Rexam Z-20A |
| 218 | 1.200 | 1.325 | 92-97 | 70-85 | Tri-State TS PRX13NC, Rexam L-13A, Kerr VL-13 |

Thus, it can be seen that the positioning of the first, second and third teeth 210, 214, 218 and the first, second, third and fourth contact sections 208, 212, 216, 220 can enable caps of many different common sizes to be centered without snagging, and can also enable vials of many different common sizes to be gripped with one of the sets of teeth 210, 214, 218 on the three different clamps 200.

Figure 24:
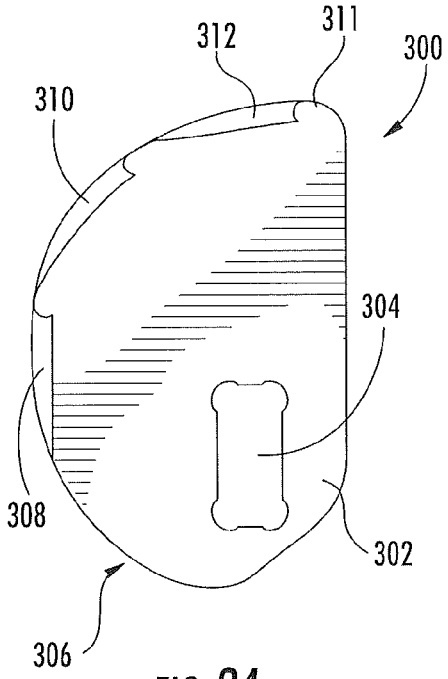
FIG. 24 is top view of a clamp for a closure station of the system of FIG. 2 according to alternative embodiments of the present invention.
Figure 25:
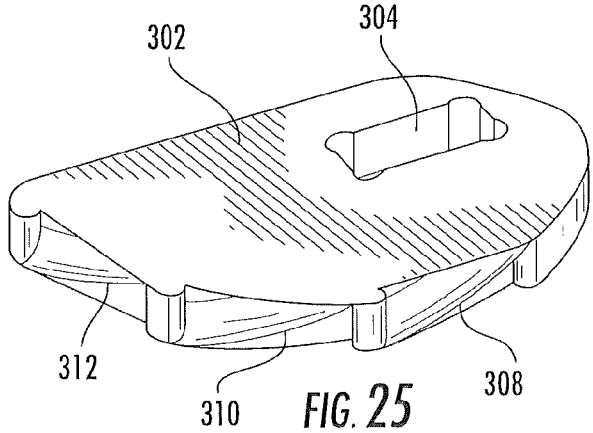
FIG. 25 is a perspective view of the clamp of FIG. 24.
Figure 26:
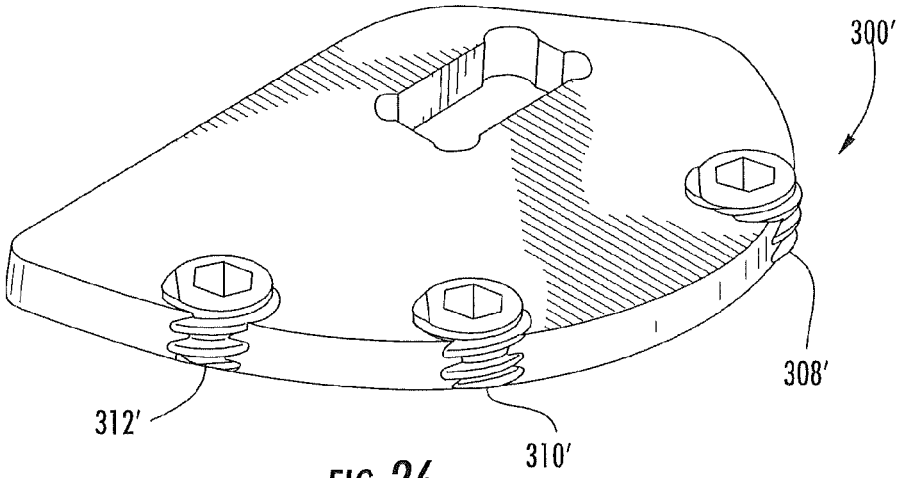
FIG. 26 is a perspective view of an alternative embodiment of the clamp of FIG. 24.
Figure 27:
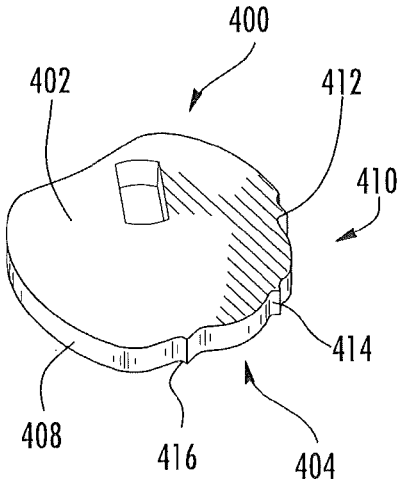
FIG. 27 is a perspective view of a clamp for a closure station of the system of FIG. 2 according to additional embodiments of the invention.
Figure 28:
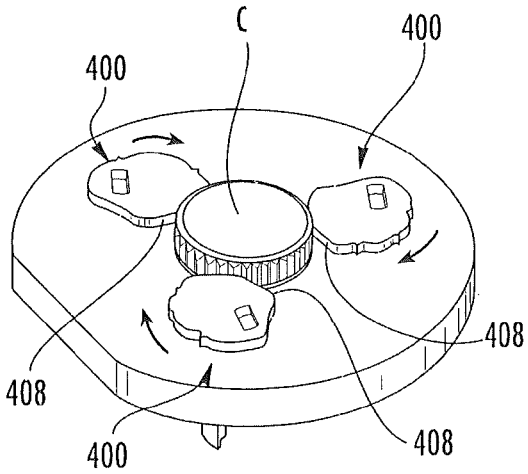
FIG. 28 is a perspective view of three clamps of FIG. 27 centering a cap.

An alternative embodiment of a clamp is shown in FIGS. 24-26 and designated broadly at 300. The clamp 300 has a similarly shaped body 302, aperture 304 and edge 306 as the clamp 200, but includes one or more angled screw-style threads 308, 310, 312 rather than teeth to engage a vial. The center points of the screw threads 308, 310, 312 may be separated from each other by angular gaps similar to those of the first, second and third teeth 210, 214, 218 of the clamp 200. The clamp 300 operates in the same manner as the clamp 200, but because the threads 308, 310, 312 have no sharp vertical edges, they tend not to snag on a cap as the cap is being pushed by the clamp 300 toward the center of the main stage 138.

Notably, the screw threads 308, 310, 312 are obliquely angled relative to the main stage 138 such that the threads 308, 310, 312 slope downwardly as they extend toward the far end 311 of the clamp 300. The angling of the threads 308, 310, 312 in this manner can urge the vial downwardly as the teeth "bite" into the vial.

The screw threads 308, 310, 312 can take the single-thread form illustrated in FIGS. 24 and 25, or may take a multi-threaded form as shown in the clamp 300' of FIG. 26. In the clamp 300', the threads 308', 310', 312' may be provided in the form of a set screw or similar component that is inserted into an aperture in the clamp 300'. In some embodiments, a single inclined thread may extend along the entirety of the arcuate edge of the clamp, with the inclination in the thread urging the vial downward as the edge engages the vial.

A further alternative embodiment of a clamp is shown in FIGS. 27-30 and designated broadly at 400. The clamp 400 differs from the clamps 200, 300, 300' in that it has a differently shaped body 402, which in turn provides a differently shaped edge 404. The edge 404 can be divided into a generally arcuate cap contact section 408 and a vial engaging section 410, which includes three separated teeth 412, 414, 416. The teeth 412, 414, 416 are separated from each other by similar angular distances as are defined for the clamp 200.

Figure 29:
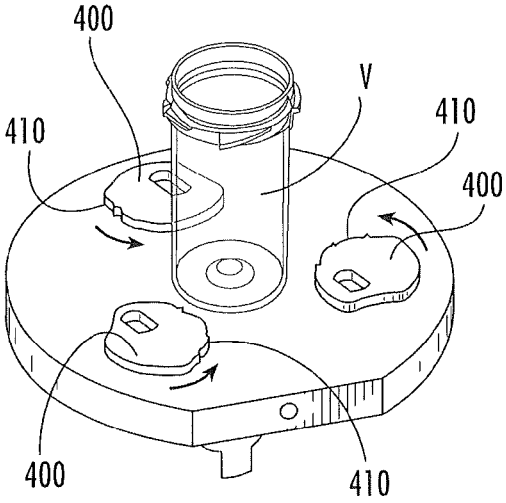
FIG. 29 is a perspective view of the three clamps of FIG. 28 rotating to center a vial.
Figure 30:
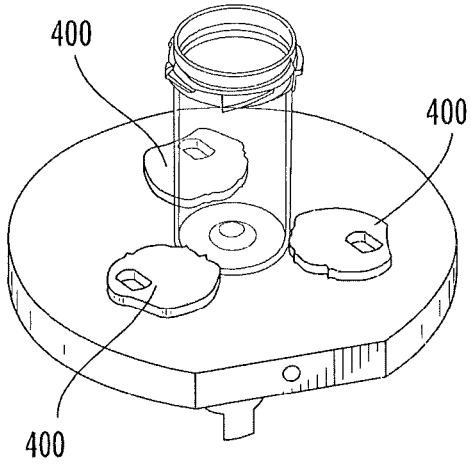
FIG. 30 is a perspective view of the three clamps of FIG. 28 gripping a vial.

The clamp 400 is connected to the drive and clutch mechanisms such that it rotates in one direction (e.g., clockwise) to center a cap C (see FIG. 28), and rotates in the opposite direction (e.g., counterclockwise) to center and grip a vial (see FIGS. 29 and 30). Thus, clamps 400 contact a cap only with their cap contact portions 408, which have no teeth on which the cap can snag, and engage a vial with one of the teeth 412, 414, 416 of the vial engaging portion 410. In such an arrangement, the clamps 400 may retract to a neutral position beneath the upper stage 152, then rotate from the neutral position in one direction to center caps and from the neutral position in the other direction to grasp vials.

It can be seen that, by presenting the cap contact portions 408 of the clamps 400 when centering caps, there are no teeth on which caps can snag.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for securing a cap onto a cylindrical container, the cap having a larger diameter than the container, comprising:

a main stage;

three clamps, each of the clamps pivotally attached to the main stage and rotatable about a respective axis of rotation, wherein the axes of rotation of the clamps define an outer circle having a center, each of the clamps comprising a generally planar body and an arcuate edge, wherein the arcuate edge comprises a toothed section and a contact section;

wherein the clamps may take a neutral position, in which a cap may be positioned between the clamps with at least one clamp not contacting the cap, and wherein rotation of each of the clamps from the neutral position in a first rotative direction presents the contact section of each clamp to contact a cap resting on the main stage, and rotation of each of the clamps from the neutral position in a second opposite rotative direction presents the toothed section of each clamp to contact a container resting on the main stage.

2. The apparatus defined in claim 1, wherein the toothed section includes separate first, second and third teeth, wherein each of the first, second and third teeth has a tip, and wherein each of the first, second and third teeth are located such that, when the clamps are pivoted about their respective axes of rotation, the tips of the first teeth present the leading points of contact of the clamps in a first annulus concentric with the outer circle and having inner and outer diameters of between 1.800 and 1.975 inches, the tips of the second teeth present the leading points of contact of the clamps in a second annulus concentric with the outer circle and having inner and outer diameters of between 1.430 and 1.530 inches, and the tips of the third teeth present the leading points of contact of the clamps in a third annulus concentric with the outer circle and having inner and outer diameters of between 1.200 and 1.325 inches.

3. The apparatus defined in claim 2, wherein the tip of the first tooth is separated by an arc of between 33 and 38 degrees from the tip of the second tooth and by an arc of between 65 and 70 degrees from the tip of the third tooth.

* * * * *